US005707164A

United States Patent [19]

Iwamoto et al.

[11] Patent Number: 5,707,164

[45] Date of Patent: Jan. 13, 1998

[54] LIQUID APPLICATOR AND A CLICKING MECHANISM AT THE TAIL END OF THE SAME

[75] Inventors: Yukio Iwamoto; Shin Inoue, both of Yokohama, Japan

[73] Assignee: Mitsubishi Pencil Kabushiki Kaisha, Tokyo, Japan

[21] Appl. No.: 654,683

[22] Filed: May 29, 1996

[30] Foreign Application Priority Data

| | | | |
|---|---|---|---|
| Jun. 6, 1995 | [JP] | Japan | 7-139131 |
| Jun. 23, 1995 | [JP] | Japan | 7-157990 |
| Mar. 22, 1996 | [JP] | Japan | 8-066397 |
| Apr. 9, 1996 | [JP] | Japan | 8-086595 |

[51] Int.·Cl.[6] ..... B43K 8/00

[52] U.S. Cl. ..... 401/206

[58] Field of Search ..... 401/196, 205, 401/206

[56] References Cited

U.S. PATENT DOCUMENTS

| | | | |
|---|---|---|---|
| 3,682,559 | 8/1972 | Hirota | 401/205 X |
| 4,685,820 | 8/1987 | Kremer et al. | 401/206 X |
| 4,902,155 | 2/1990 | Buschemeyer | 401/206 |
| 4,913,175 | 4/1990 | Yokosuka et al. | 401/206 X |
| 5,035,524 | 7/1991 | Sakurai | 401/206 |

FOREIGN PATENT DOCUMENTS

| | | | |
|---|---|---|---|
| 3303341 | 8/1984 | Germany | 401/206 |
| 62-109980 | 7/1987 | Japan . | |
| 6-18616 | 5/1994 | Japan . | |

*Primary Examiner*—William E. Stoll
*Attorney, Agent, or Firm*—Darby & Darby

[57] ABSTRACT

An applicator or a tail clicking structure used in various modes of the applicators includes: a barrel cylinder storing a liquid in its inside; a clicking portion formed at the tail; a valve rod connected to the front end of a small-diameter pipe which is connected at its rear end to the clicking portion; a valve seat which is fixed at the front end opening of the barrel cylinder and slidably holds the valve rod at a position behind a large-diameter portion so that the large-diameter portion abuts or separates from the seat. The applicator further includes: a valve spring which is abutted at its rear end against the large-diameter portion so as to urge the valve rod backward; a spring receiver which is fitted into the front part of the valve seat so as to support the front end of the valve spring and has a guide hole for guiding the front end of the valve rod; and a pen tip to which the liquid inside the barrel cylinder is supplied during clicking operations.

10 Claims, 28 Drawing Sheets

LIQUID APPLICATOR AND A CLICKING MECHANISM AT THE TAIL END OF THE SAME

BACKGROUND OF THE INVENTION (1) Field of the Invention

The present invention relates to liquid applicators such as writing implements, cosmetic applicators and the like and also relates to a clicking mechanism located at the tail end of the same.

(2) Description of the Prior Art

Conventionally, many of the liquid applicators such as writing implements which directly store ink inside their barrel cylinders, cosmetic applicators which store manicure liquid or other cosmetic liquids inside their barrel cylinders, are provided with a valve device inside the barrel cylinder in order to adjust the ejected amount of ink, manicure liquid etc. There have previously been several clicking mechanisms proposed for the valve to be opened and closed. One of these is provided with a bellows portion in the barrel cylinder so that the implement can be clicked in the axial direction utilizing the squeezable function of the bellows portion (see Japanese Utility Model Application Laid-Open Sho 62 No. 109,980, Japanese Utility Model Publication Hei 6 No. 18,616).

For example, the conventional valve device disclosed in Japanese Utility Model Publication Hei 6 No. 18,616, is mainly composed of a small-diameter pipe which extends forward inside the barrel from the inner end face of the bellows portion, a valve rod which is connected at the front end of the small-diameter pipe, a valve seat against which a tapered, stepped portion of the valve rod is abutted so as to hermetically seal the barrel cylinder and from which the stepped portion is separated when the valve rod is moved forward, a valve spring which is disposed with its rear end abutting the front face of the stepped portion of the valve rod and urges the valve rod backward, and a spring receiver which receives the valve spring and has an application liquid hole in the center thereof.

In accordance with the valve device, as the user pushes the bellows portion, the small-diameter pipe is thrust forward, thus moving the valve rod forward. In this way, the applying liquid can be supplied to the pen tip through the gap formed between the stepped portion of the valve rod and through the valve seat and the application liquid hole. When the pressure exerted by the user is released from the bellows portion, the valve rod moves backward due to the urging force of the valve spring so that the stepped portion abuts the valve seat and therefore the barrel cylinder will hermetically be sealed.

However, in the conventional applicator described above, since the valve rod is supported only by the valve seat, the valve rod, in particular, the part at the front end thereof sways whilst the rod is being moved back and forth during clicking operation. This might diminish the sliding performance of the valve rod at and around the valve seat.

Further, since the stroke length of the clicking portion is not constrained, the clicking portion might be pressed with a stronger force than required so that the bellows portion could be stressed beyond the limit of elasticity. In such a case, the bellows portion might be broken or be cracked due to the repeated stresses.

The amount of the applying liquid to be supplied to the pen tip (felt, sliver, brush bristles etc.) should be equivalent to the reduction of the volume of the ink reservoir when the bellows portion is squeezed. However, if the user continuously pressed the clicking portion of the implement, the liquid inside the barrel cylinder would be over-supplied to the pen tip due to the effect of exchange with the outside air which would flow in through the pen tip. As a result, an excessive amount of the applying liquid flows out, possibly causing troubles. With all the circumstances, there have been strong demands for a liquid applicator which has a valve structure which can, by controlling precisely the amount of the liquid to the pen tip, adjust the amount of the liquid finally ejected.

Meanwhile, since the conventional liquid applicator with the bellows portion uses thus squeezing functions as stated above, it is preferable that pressure to be exerted on the bellows portion be set low enough to be suitable for its normal usage. Specifically, it is considered to be preferable that the wall thickness of the bellows portion is set at about 0.3 to 0.4 mm. However, as the wall thickness of the sleeve portion of the barrel cylinder to which the bellows portion is attached is typically about 0.8 mm, it has previously been quite difficult to form the barrel cylinder using a blow container which is produced by direct blowing or injection blowing. As a result, it has been almost impossible to shape the bellows portion into the dimensions specified by the aforementioned wall thickness.

That is, in the case where the bellows portion is formed with thin walls, the thickness might become irregular in the bellows portion. Further, in this case, there is a possibility that stress will build up in the base or root of the bellows portion, the root portion might be cracked or broken down.

Further, because the bellows portion is integrally formed with the barrel cylinder, if the bellows portion is formed with a soft material in order to allow easy clicking operations, the barrel cylinder also will have to be soft. This gives rise to the problem that the sleeve of the barrel cylinder can easily be deformed at the time of usage (when the user grips the implement).

Moreover, in the normal assembly of a liquid applicator of this kind, the barrel cylinder is filled up with the applying liquid. Then, the small-diameter pipe with the valve device attached at the front end is inserted as a connecting part into the barrel cylinder. The rear end of the small-diameter pipe is made to abut the inner end face of the bellows portion. In assembling, the rear end of the small-diameter pipe is preferably positioned at the center of the inner end face of the bellows portion so as to allow desirable clicking operations at the time of usage.

However, in the conventional liquid applicator stated above, if the small-diameter pipe is inclined inside the barrel cylinder, it becomes difficult to position the rear end of the small-diameter pipe to the center of the inner end face of the bellows portion. Further, even if the rear end of the small-diameter pipe is positioned at the center of the inner end face of the bellows portion, the setting of the rear end of the small-diameter pipe could be displaced within the inner end surface of the bellows portion during clicking operations.

SUMMARY OF THE INVENTION

The present invention has been achieved in view of the conventional problems discussed above, and it is therefore an object of the present invention to provide a liquid applicator such as a writing implement, cosmetic applicator etc., which is improved in its sliding performaces of the valve rod and the durability of the clicking portion and can by controlling precisely the amount of the liquid supplied, prevent the applying liquid from being excessively ejected.

Another object of the invention is to provide a tail clicking structure of liquid applicators such as writing implements, cosmetic applicators etc., in which the pressure to be exerted on the clicking portion can be set low enough to be suitable for normal use and which is improved in the durability of the clicking portion against clicking operations.

A further object of the invention is to provide a tail clicking structure of the liquid applicators such as writing implements, cosmetic applicators etc., which enables the rear end of the connecting part to be positioned at the center of the clicking portion when it is assembled and which reliably holds the rear end of the connecting portion in the clicking portion.

In order to attain the above objects the present invention has the following features:

The first gist of the invention resides in that a liquid applicator includes:

a barrel cylinder storing an applying liquid therein;

a clicking portion which is disposed at the tail end of the barrel cylinder and is pressed forward during the clicking operation to reduce the content volume of the liquid applicator;

a connecting part which is connected at the end thereof with the clicking portion and is extended forward inside the barrel cylinder;

a valve rod which is connected to the front end of the connecting part and has a large-diameter portion projected outward in the radial directions;

a valve seat of a substantially cylindrical shape, which is fitted in the front end opening of the barrel cylinder for slidably supporting the valve rod at a position behind the large-diameter portion, and against which the large-diameter portion is abutted during the non-clicking state and from which the large-diameter portion is separated during the clicking action;

an urging means abutted against the rear end of the large-diameter portion for urging the valve rod backward;

a supporting member which is fitted in the front end portion of the valve seat for supporting the front end of the urging means and has a guide hole for guiding the front end portion of the valve rod; and an applying piece which is disposed in front of the guide hole and to which the applying liquid is supplied from the barrel cylinder through the gap between the large-diameter portion and the valve seat and the gap between the guide hole and the valve rod when clicking is performed.

The second gist of the invention resides in that a liquid applicator has the first feature and is characterized in that the front end of the connecting part abuts the rear end of the valve seat when the connecting part is moved forward by a predetermined stroke length.

The third gist of the invention resides in that a liquid applicator has the first feature and is characterized in that the valve rod has a stepped surface which abuts the surface of the inner peripheral wall of the guide hole when the valve rod is moved forward by a predetermined stroke length.

The fourth gist of the invention resides in that a liquid applicator has the third feature and is characterized in that the supplying passage of the applying liquid to the applying piece is blocked by the combination of the stepped surface of the valve rod and the surface of the inner peripheral wall of the guide hole when the valve rod is moved forward by a predetermined stroke length.

The fifth gist of the invention resides in that a liquid applicator has the first feature and is characterized in that the large-diameter portion of the valve rod abuts the rear end of the supporting member when the valve rod is moved forward by a predetermined stroke length.

The sixth gist of the invention resides in that a liquid applicator has the fifth feature and is characterized in that the supplying passage of the applying liquid to the applying piece is blocked by the combination of the large-diameter portion of the valve rod and the rear end of the supporting member when the valve rod is moved forward by a predetermined stroke length.

The seventh gist of the invention resides in that a liquid applicator has the first feature and is characterized in that the clicking portion is formed in a tail plug which is fitted in the rear end part of the barrel cylinder, and comprises: a thin wall which is attached on the inner peripheral wall of the tail plug and is connected to the rear end of the connecting part; a push cap which is connected to the rear face of the thin wall and is capable of sliding back and forth along the inner peripheral wall of the tail plug behind the thin wall; and a projection against which the front end of the push cap abuts when the push cap is moved forward by a predetermined stroke length.

The eighth gist of the invention resides in that a clicking mechanism located at the tail end of a liquid applicator such as a writing implement, a cosmetic applicator and the like, which has a barrel cylinder storing an applying liquid therein and a clicking portion disposed at a tail end thereof and clicked in the axial direction to open a valve provided inside so that the applying liquid flows out from the applying piece, includes:

a resilient body which seals the tail end and can restorably be deformed during clicking operations; and a projected portion which is made up of a synthetic resin material and integrally formed on the entire circumference of the inner peripheral surface of the tail end in such a manner that the projected portion is projected inward from the inner surface and has a bent portion in the upper part thereof which extends to at least one side along the axial direction, and is constructed so that after the projected portion has been formed, the resilient body is molded of an elastic material in such a manner that a circular outer part of the resilient body hermetically grips the projected portion.

The ninth gist of the invention resides in that a clicking mechanism has the eighth feature and is characterized in that the clicking mechanism comprises:

a resilient body which seals the tail end of the barrel cylinder and can restorably be deformed during clicking operations; and a projected portion which is made up of a synthetic resin material and integrally formed on the entire circumference of the inner peripheral surface of the tail end of the barrel cylinder in such a manner that the projected portion is projected inward from the inner surface and has a bent portion in the upper part thereof which extends to at least one side along the axial direction, and is constructed so that after the projected portion has been formed, the resilient body is molded of an elastic material in such a manner that a circular outer part of the resilient body hermetically grips the projected portion, and the inner peripheral surface of the barrel cylinder which lies ahead of the projected portion has a feature which allows the core for forming the inner peripheral surface to be separated forward.

The tenth gist of the invention resides in that a clicking mechanism has the eighth feature and is characterized in that the valve is opened via a connecting part so as to allow the applying liquid to flow through the applying piece, the resilient body has a depressed portion at the approximately central portion thereof which is opened up to the front side and into which the rear end of the connecting part is fitted, and a slanting surface for guiding the rear end of the connecting part to the center of the depressed portion when the connecting part is inserted into the barrel cylinder from the front side at the time of assembling is formed in front of the depressed portion.

In accordance with the invention of the first gist, as the user clicks the clicking portion, the pressure is transferred via the connecting part to move the valve rod forward resisting the urging force generated by the urging means. As the valve rod moves forward, the large-diameter portion of the valve rod separates from the valve seat so that the valve is opened. By the release of the valve and the decrease of the content volume of the applicator, the applying liquid is supplied from the barrel cylinder to the applying piece through the gap between the large-diameter portion and the valve seat and the gap between the guide hole of the supporting member and the valve rod. When the user stops pushing the clicking portion, the valve rod is moved backward by virtue of the urging means so that the large-diameter portion abuts the valve seat to close the valve again. In this condition or in the non-clicked state, the supplying of the applying liquid to the applying piece is stopped.

Since the front part of the valve rod is guided by the guide hole of the supporting member, the sway of the valve rod can be inhibited, whereby the sliding performance of the valve rod against the valve seat is improved.

In accordance with the second, third, fifth and seventh features of the invention, since the movement of the connecting part, valve rod or push cap is prohibited when the clicking stroke reaches a predetermined stroke length, it is possible to prevent the clicking portion from being pushed in excess of what is required. Therefore, it is possible to avoid the occurrence of stresses in the clicking portion beyond the limit of elasticity, thus the durability of the clicking portion can be increased. Besides, it is possible to make such a structure that the movement of the valve rod can stop before the front end of the valve rod abuts the applying piece, whereby it is possible to prevent the applying piece from being pushed out by the valve rod.

Further, in accordance with the fourth and sixth features of the invention, since the supplying passage of the applying liquid to the applying piece is shut off when the valve rod is moved forward by the predetermined stroke length, only a specific amount of the applying liquid corresponding to the predetermined stroke length, or specifically the reduced volume of the applicator due to the deformation of the clicking portion will be supplied to the applying piece. Accordingly, it is possible to exactly control the flow amount of the applying liquid supplied to the applying piece by a single clicking operation, whereby it is possible to reliably prevent excessive flow of the liquid.

Next, in accordance with the eighth feature of the invention, since the resilient body which is deformable during clicking operations is formed separately from the barrel cylinder, it is possible to freely design the resilient body in a flexibly shape which allows easy clicking operations, without affecting the material and wall thickness of the barrel cylinder. Further, since the resilient body is molded so that the outer peripheral part hermetically grips the projected portion, the resilient body will not detach from the projected portion even if an excessive pressure is exerted when it is clicked. Accordingly, it is possible to improve the durability of the clicking portion against clicking operations. Moreover, since the outer peripheral part of the resilient body comes into hermetic contact with the projected portion, it is possible to reliably seal the applying liquid inside the barrel cylinder.

The term 'inner peripheral surface of the tail end' indicates the inner peripheral surface of the tail barrel fitted to the barrel cylinder or the inner peripheral surface of the tail end portion of the barrel cylinder itself.

The ninth feature of the invention, in addition to the functions and effects in the eighth feature of the invention, produces effects as follows: That is, since the inner peripheral surface of the barrel cylinder which lies ahead of the projected portion is constituted by a shape which allows the core to be separated forward, it is possible to separate the metal mold by pulling the core in the forward direction after the inner peripheral surface of the barrel cylinder has been formed. In contrast, if the mouth portion of the barrel cylinder is formed with a smaller diameter, a stepped portion will be formed on the inner peripheral surface of the barrel cylinder. Accordingly, the stepped portion forms an undercut which prohibits the separation of the core. Here, 'a shape which allows the core to be separated forward' in the invention, means that the shape which permits the outer peripheral surface of the core to be pulled out toward the front side from the inner peripheral surface of the barrel cylinder after the barrel cylinder has been molded and involves the cylindrical surface having a forcibly pulling-able thread. Here, the 'forcibly pulling-able thread' means a male thread portion which is formed by molding the barrel cylinder using a core capable of forming a male thread on the inner peripheral surface of the barrel cylinder and forcibly pulling the core from the barrel cylinder in the axial direction utilizing the elasticity of the resin.

Further, in accordance with the tenth feature of the invention, when the connecting part is inserted into the barrel cylinder from the front side at the time of assembling, if the connecting part inserted inside the barrel cylinder is inclined against the central axis of the barrel cylinder, the connecting part is guided to the central position of the depressed portion along the slanting surface formed in front of the depressed portion. Accordingly, at the time of assembling, it is possible to readily position the rear end of the connecting part to the center of the clicking portion. Besides, since the rear end of the connecting part is fitted in the depressed portion, it is possible to reliably hold the connecting part in the clicking portion even during clicking operations.

DESCRIPTION OF THE PREFERRED EMBODIMENTS

Embodiments of the invention will hereinafter be described with reference to the accompanying drawings.

Figure 1:
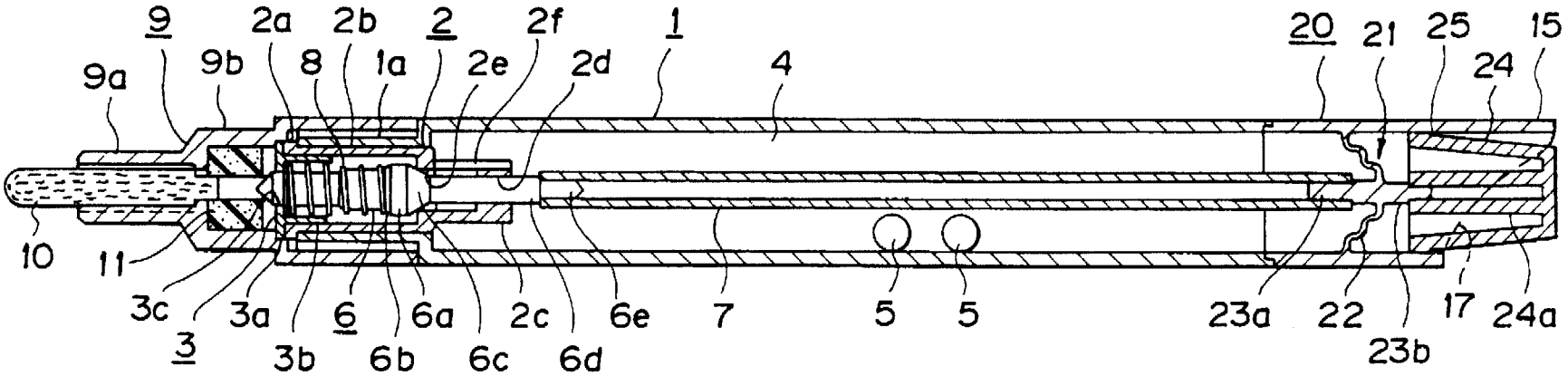
FIG. 1 is a vertical sectional view showing a writing implement of the first embodiment.

FIG. 1 shows a writing implement of a first embodiment of the invention.

The first embodiment is a writing implement, as shown in FIG. 1, having a barrel cylinder 1 which reserves ink (an example of the applying liquid) therein. Provided at the rear end is a clicking portion 21 which is clicked in the axial direction whereby a value provided inside is opened so that the applying liquid flows out from the pen tip.

The writing implement includes: the barrel cylinder 1; the clicking portion 21 which is pressed forward during clicking to reduce the volume of the applicator; a small-diameter pipe 7 (corresponding to a connecting part) which is connected at its rear end to the clicking portion 21 and expends forward inside the barrel cylinder 1; a valve rod 6 which is connected to the front end of the small-diameter pipe 7 and has a large-diameter portion 6*a* projected radially; a valve seat 2 which is fixed at the front end opening of the barrel cylinder 1 and slidably holds the valve rod 6 at a position behind the large-diameter portion 6*a* so that the large-diameter portion 6*a* abuts the valve seat 2 during the non-clicking state and is separated from the seat during clicking. Further, the writing implement includes: a valve spring (an example of an urging means) 8 which is abutted at its rear end against the large-diameter portion 6*a* so as to urge the valve rod 6 backward; a spring receiver (corresponding to a supporting member) 3 which is fitted into the front part of the valve seat 2 so as to support the front end of the valve spring 8 and has a guide hole 3*c* for guiding the front end of the valve rod 6; and a pen tip 10 (an example of an applying piece) to which ink inside the barrel cylinder 1 is supplied through the gap between the large-diameter portion 6*a* and the valve seat 2 and through the gap between the guiding hole 3*c* and the valve rod 6 when clicking is performed.

Now, the structures of the parts will be detailed. As shown in FIG. 1, the barrel cylinder 1 is made of a synthetic resin and is opened at both the front and rear ends. The space behind the valve seat 2 in the barrel cylinder 1 is used as an ink reservoir 4 in which an ink agitating ball 5 is idly provided as required. A mouth portion 1*a* at the front end of the barrel cylinder 1 is formed in a smaller diameter than the other parts.

The clicking portion 21 is integrally formed with a tail plug 20 which is fitted on the rear end of the barrel cylinder 1. The clicking portion 21 has a thin wall 22 which is attached on the inner peripheral wall of the tail plug 20 and connected to the rear end of the small-diameter pipe 7, and a push cap 24 which is connected to the rear face of the thin wall 22 and is capable of sliding back and forth along the inner peripheral wall of the tail plug 20 behind the thin wall 22.

The thin wall 22 is formed in a stepped manner and is integrally formed with a pair of rod-shaped, front and rear ribs 23*a* and 23*b*, which are disposed in the center in the transverse cross-section. The push cap 24 is a molding article which is somewhat reduced in diameter or tapered toward the rear end and has a cylindrical rib 24a therein. The push cap 24 is held inside the tail plug 20 by a projection 25 provided on the inner peripheral wall of a cover portion 15 whilst the rib 24a is being fitted onto the rib 23b. The front rib 23a is projected toward the ink reservoir 4 and connected to the rear end of the small-diameter pipe 7. Designated at 17 is a cutaway portion for the user's finger to be fitted.

The valve rod 6 has the large-diameter portion 6a in the approximately central portion with respect to the longitudinal direction. A stepped portion 6b facing forward is formed at the front end of the large-diameter portion 6a. A stepped portion 6c which is tapered or somewhat reduced in diameter toward the rear end is formed on the rear side of the large-diameter portion 6a. Extended behind the stepped portion 6c is a small-diameter portion 6d. Further, a connecting small-diameter portion 6e is formed from the rear end of the small-diameter portion 6d. The small-diameter portion 6d is projected rearward through the rear end face of the valve seat 2 and the connecting small-diameter portion 6e at the rear end is press-fitted into the front end opening of the small-diameter pipe 7.

The valve seat 2 is composed of: a flange portion 2a which abuts the end face of the mouth portion 1a of the barrel cylinder 1; a large-diameter tubular portion 2b fitted into the mouth portion 1a; a small-diameter tubular portion 2c projected out from the rear end of the large-diameter tubular portion 2b into the ink reservoir 4; a supporting hole 2d which is formed through the rear wall of the small-diameter tubular portion 2c to slidably support the small-diameter portion 6d of the valve rod 6; a valve hole 2e for the transference between the large-diameter tubular portion 2b and the small-diameter tubular portion 2c; and an opening 2f which is formed on the side wall of the small-diameter tubular portion 2c.

The stepped portion 6c of the valve rod 6 is removably abutted against the front opening rim of the valve hole 2e; the transference between the ink reservoir 4 and the interior of the large-diameter tubular portion 2b is shut off during the non-clicking state whereas the valve rod 6 is moved forward at the time of the clicking operation so that the transference between the ink reservoir 4 and the interior of the large-diameter tubular portion 2b is created through the opening 2f.

The valve spring 8 is fitted substantially around the front half of the valve rod 6 with its front end abutted against the stepped portion 6b of the large-diameter portion 6a, to thereby constantly urge the valve rod 6 rearward.

The spring receiver 3 comprises: a flange portion 3a abutted against the flange portion 2a of the valve seat 2; the guide hole 3c formed in the center of the flange 3a; and a fitting portion 3b which is fitted into the front part of the large-diameter tubular portion 2b of the valve seat 2. Examples of the guide hole 3c include a circular hole having an inside diameter greater than the outside diameter of the front part of the valve rod 6, or a circular hole which is formed on its interior side with a plurality of ribs frictionally contacting the valve rod 6.

A front barrel 9 is screwed on the peripheral side of the mouth portion 1a of the barrel cylinder 1 so as to sandwich the flange portions 2a and 3a of the valve seat 2 and spring receiver 3 in cooperation with the front end face of the mouth portion 1a. A plurality of ribs 9a which are radially and inwardly projected are formed at positions required (positioned 120° apart on the circumference) on the inner surface of the center hole of the front barrel 9.

The pen tip 10 made up of felt, sliver or brush bristles etc., is held by the ribs 9a of the front barrel 9. The face at the rear end of the pen tip 10 faces the guide hole 3c of the spring receiver 3. A middle-diameter portion 9b is formed in the approximately longitudinal center of the front barrel 9 and a sponge piece 11 is fitted in the hollow of the middle-diameter portion 9b. Fitted into a center hole of the sponge piece 11 is the rear end of the pen tip 10. An unillustrated cap will detachably be fitted on the peripheral part of the front barrel 9 in the front part of the barrel cylinder 1.

Figure 2A:
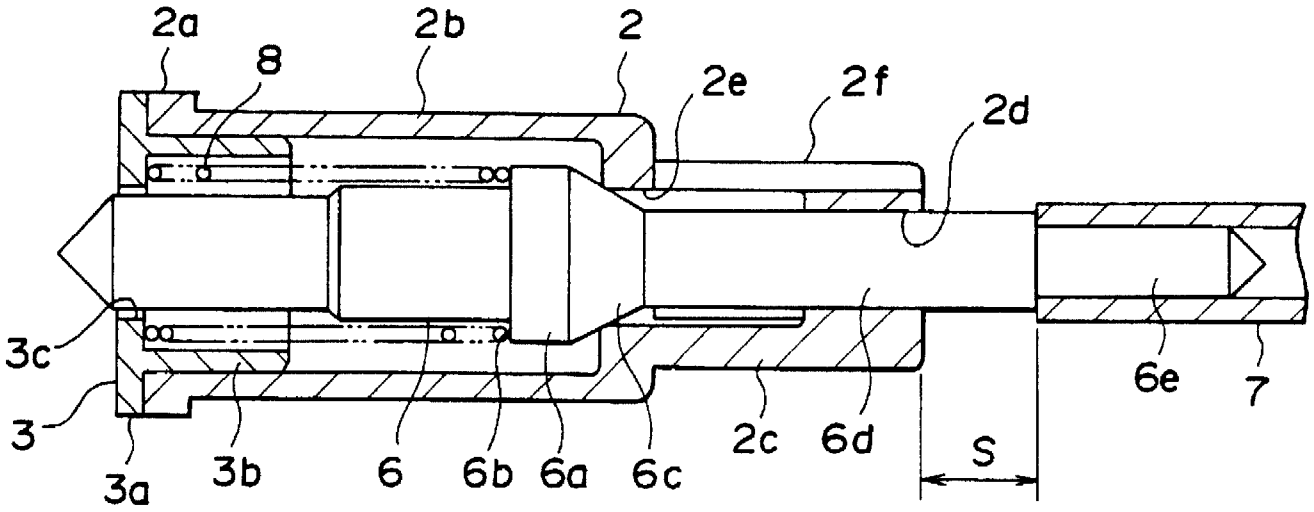
FIG. 2A is a vertical sectional view showing the vicinity of a valve seat in accordance with the first embodiment where the implement is in the non-clicked state.
Figure 2B:
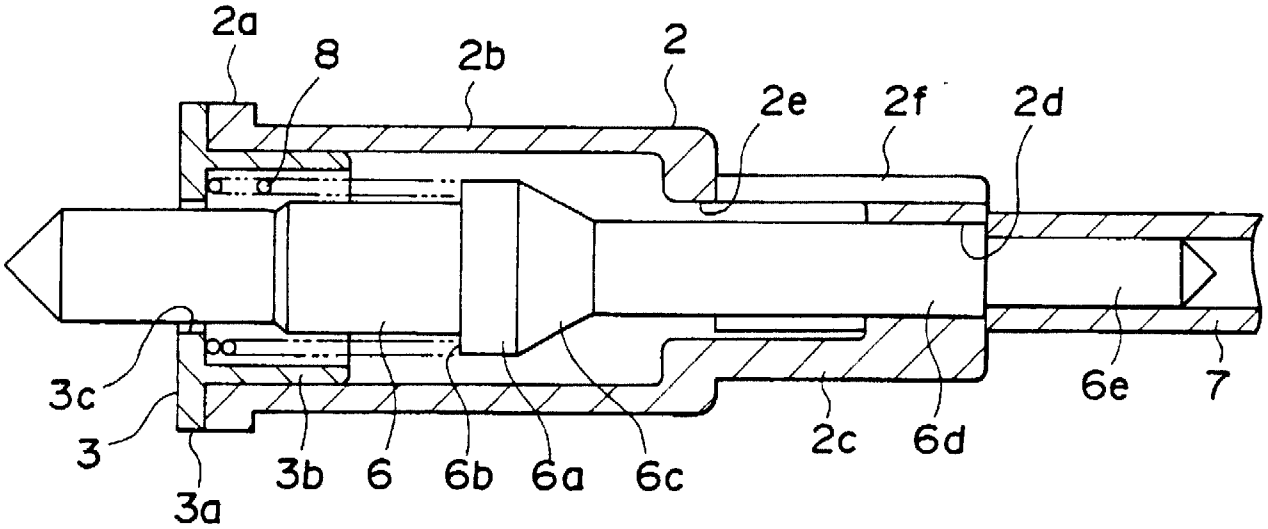
FIG. 2B is a view of FIG. 2A where the implement is in the clicked state.

In this first embodiment, as shown in FIGS. 2A and 2B, when the small-diameter pipe 7 is moved forward by a predetermined stroke length S, the front end face of the small-diameter pipe 7 abuts the rear end of the valve seat 2. That is, the outside diameter of the small-diameter portion 7 is set up to be greater than the inside-diameter of the supporting hole 2d of the valve seat 2 and the distance between the front end of the small-diameter pipe 7 and the rear end of the valve seat 2 in the non-clicking state is set at the predetermined stroke length S.

The predetermined stroke length S is set so that the deformation of the thin wall 22 of the clicking portion 21 will be within its elastic range and the front end of the valve rod 6 will not interfere with the rear end of the pen tip 10 during the clicking action.

In accordance with the first embodiment thus configurated, when the push cap 24 of the clicking portion 21 is clicked in the axial direction to deform the thin wall 22, the small-diameter pipe 7 is pressed forward. The advance of the small-diameter pipe 7 causes the valve rod 6 to move forward as pressing the valve spring 8 whilst it is being supported by the supporting hole 2d of the valve seat 2 and the guide hole 3c of the spring receiver 3. As the valve rod 6 moves forward, the stepped portion 6c of the valve rod 6 is separated from the front opening rim of the valve hole 2e of the valve seat 2. By the release of the valve and the decrease of the volume of the ink reservoir 4 due to the deformation of the thin wall 22, the ink inside the ink reservoir 4 flows into the large-diameter tubular portion 2b of the valve seat 2 through the opening 2f and valve hole 2e. The inflow of ink is supplied through the gap between the guide hole 3c of the spring receiver 3 and the front end of the valve rod 6 and the sponge piece 11 to the pen tip 10.

As the user presses the push cap 24 more so that the total distance that the small-diameter pipe 7 moves reaches the predetermined stroke length S, the front end face of the small-diameter pipe 7 abuts the surface of the wall around the supporting hole 2d of the valve seat 2, as shown in FIG. 2B. Thus, the valve rod 6 is prevented from moving forward beyond the predetermined stroke length S.

As the pressure exerted on the push cap 24 is released when the user stops clicking, the valve rod 6 is moved backward by the urging force of the valve spring 8 and the stepped portion 6c abuts the front end opening rim of the valve hole 2e. Consequently, in the non-clicking state, the valve is closed so that the supply of ink to the pen tip 10 will be stopped.

In accordance with the first embodiment thus functioning, since the front part of the valve rod 6, as it moves forward and backward directions, is guided also by the guide hole 3c of the spring receiver 3, the sway of the valve rod 6 can be inhibited, whereby the sliding performance of the valve rod against the valve seat 2 is improved.

Further, since the movement of the small-diameter pipe 7 is inevitably prohibited when the clicking stroke reaches the predetermined stroke length S, it is possible to prevent the clicking portion 21 from being pushed in excess of what is required. Therefore, it is possible to avoid the occurrence of stresses in the thin wall 22 beyond the limit of elasticity, thus the durability of the clicking portion 21 can be increased. Besides, since the front end of the valve rod 6 will not abut the pen tip 10, it is possible to prevent the pen tip 10 from being pushed out by the valve rod 6.

Figure 3A:
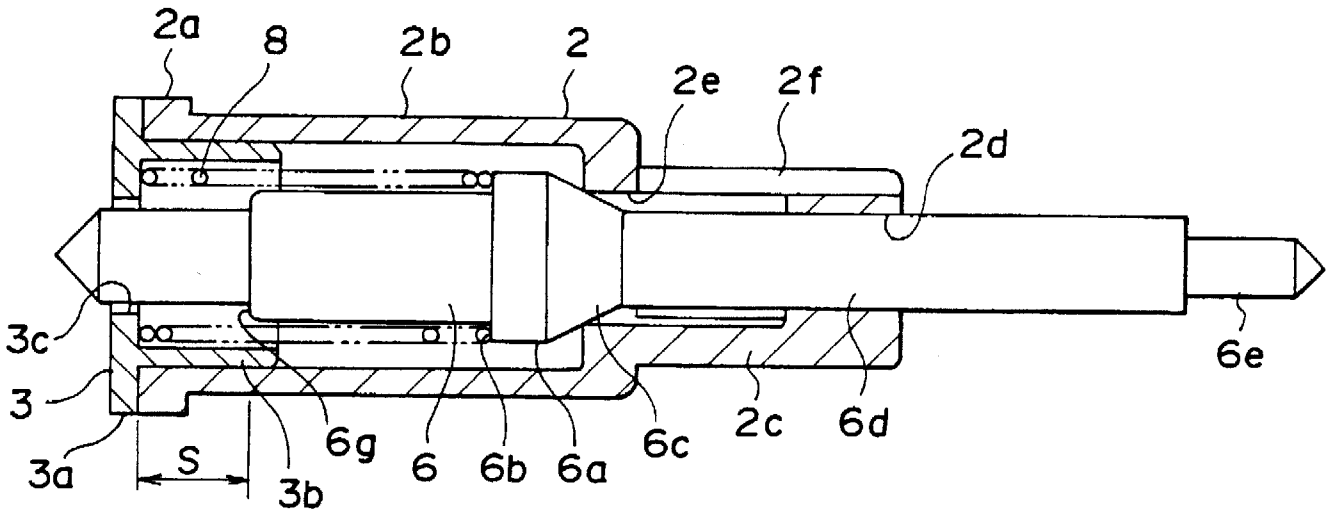
FIG. 3A is a vertical sectional view showing the vicinity of a valve seat in accordance with the second embodiment where the implement is in the non-clicked state.
Figure 3B:
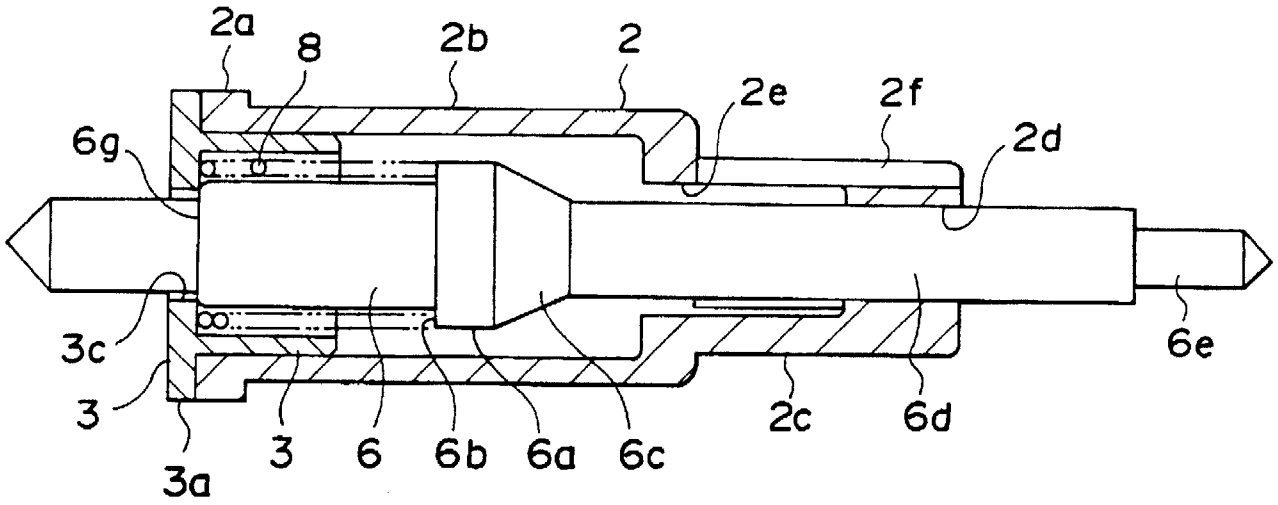
FIG. 3B is a view of FIG. 3A where the implement is in the clicked state.

Next, the second embodiment will be described. As shown in FIGS. 3A and 3B, the valve rod 6 is provided with a stepped face 6g which abuts the wall face around the guide hole 3c when the valve rod is moved forward by the predetermined stroke length S. This stepped face 6g is shaped in annular form with a greater diameter than the guide hole 3c and the whole face comes into close contact with the wall face around the guide hole 3c. Accordingly, when the valve rod 6 moved forward by the predetermined stroke length S, the stepped face 6g in cooperation with the wall face around the guide hole 3c seals the space inside the large-diameter tubular portion 2b of the valve seat 2, whereby the supplying passage of ink to the pen tip 10 is shut off.

In accordance with the second embodiment, it is possible to constrain the stroke length during clicking as in the first embodiment. In addition, since the supplying passage of ink to the pen tip 10 is shut off when the valve rod 6 is moved forward by the predetermined stroke length S, only a specific amount of ink corresponding to the predetermined stroke length S of the valve rod 6, or specifically the reduced volume of the ink reservoir 4 accompanied by the deformation of the thin wall 22 will be supplied to the pen tip 10. Accordingly, it is possible to exactly control the flow amount of ink supplied to the pen tip 10 by a single clicking operation, whereby it is possible to reliably prevent excessive flow of ink.

Figure 4A:
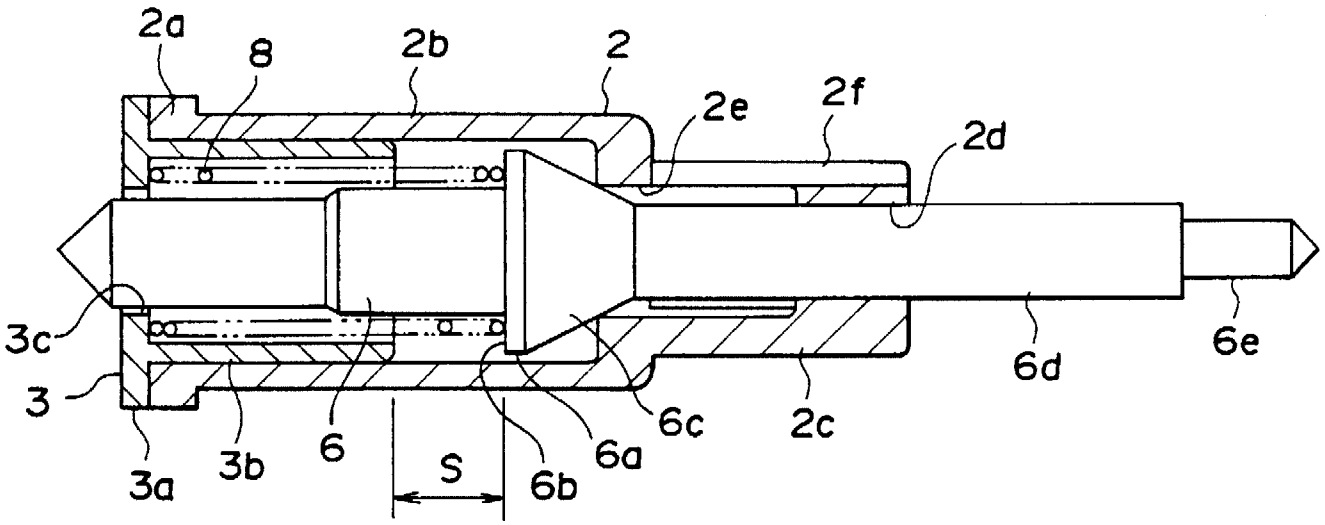
FIG. 4A is a vertical sectional view showing the vicinity of a valve seat in accordance with the third embodiment where the implement is in the non-clicked state.
Figure 4B:
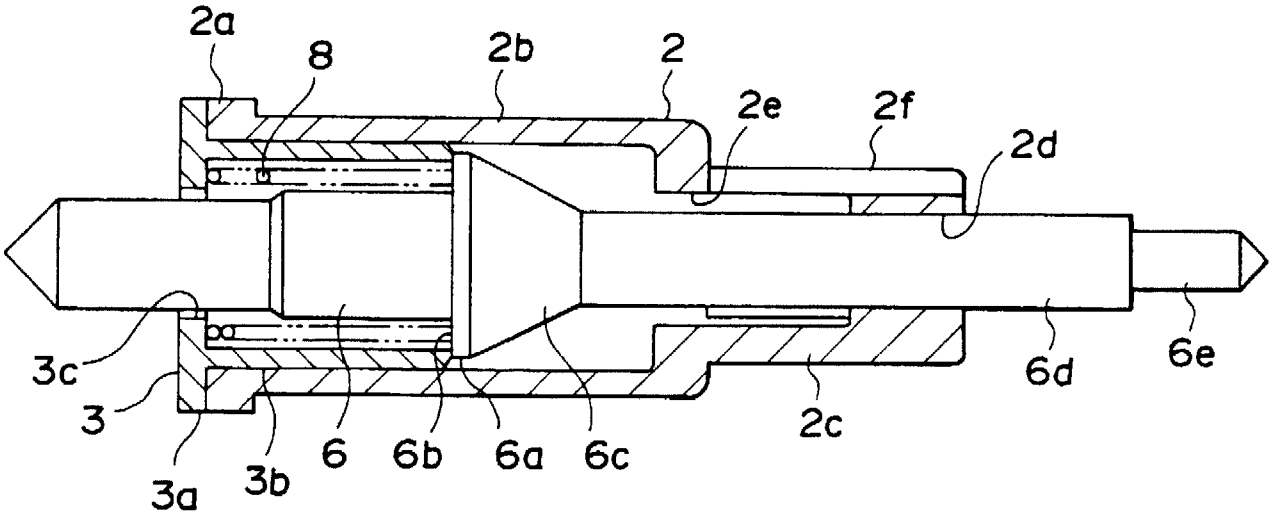
FIG. 4B is a view of FIG. 4A where the implement is in the clicked state.

Next, the third embodiment will be described. In the third embodiment, as shown in FIGS. 4A and 4B, the large-diameter portion 6a of the valve rod 6 is adapted to abut the rear end face of the spring receiver 3 when the valve rod 6 is moved forward by the predetermined stroke length S.

The outside diameter of the stepped portion 6b of the large-diameter portion 6a of the valve rod 6 is formed greater than the inside diameter of the rear part of the fitting portion 3b of the spring receiver 3. The fitting portion 3b of the spring receiver 3 is extended rearward to a greater degree as compared to that in the first embodiment so that the distance up to the stepped portion 6b will be set at the predetermined stroke length S. In this arrangement, when the valve rod 6 is moved forward by the predetermined stroke length S, the stepped portion 6b of the large-diameter portion 6a of the valve rod 6 in cooperation with the rear face of the fitting portion 3b of the spring receiver 3 shuts off the supplying passage of ink to the pen tip 10.

In accordance with the third embodiment, it is possible to constrain the stroke length during clicking as in the first embodiment. In addition, since, as in the second embodiment, the supplying passage of ink to the pen tip 10 is shut off when the valve rod 6 is moved forward by the predetermined stroke length S, it is possible to exactly control the flow amount of ink supplied to the pen tip 10 by a single clicking operation, whereby it is possible to reliably prevent excessive flow of ink.

Figure 5:
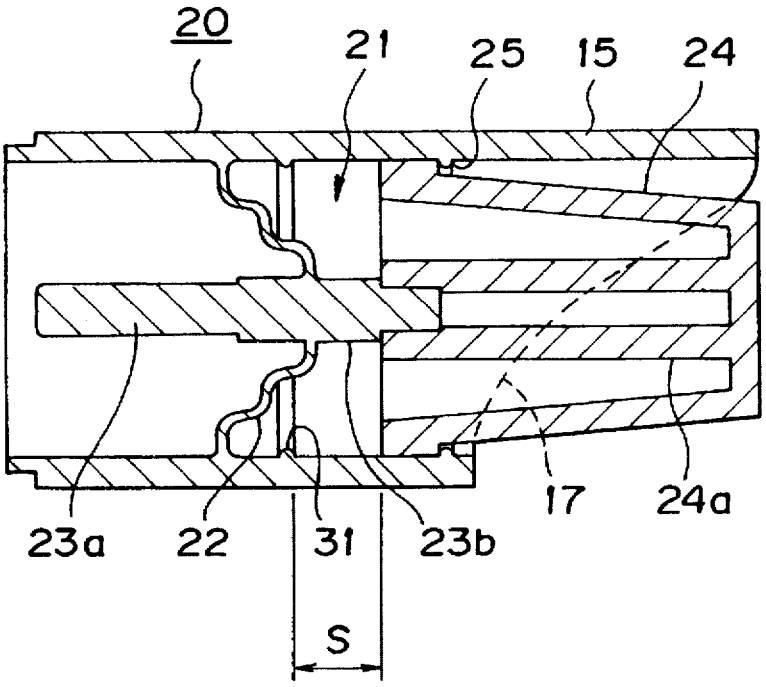
FIG. 5 is a vertical sectional view showing a tail plug in accordance with the fourth embodiment.

Next, the fourth embodiment will be described. As shown in FIG. 5, the inner peripheral wall of the tail plug 20 is formed with a projection 31 which the part at the front end of the push cap 24 abuts when the push cap 24 is moved forward by the predetermined stroke length S.

The projection 31 is formed on the whole circumference of the inner peripheral surface of the tail plug 20 and the inside diameter of the hollow defined by the projection is set to be smaller than the outside diameter of the part at the front end of the push cap 24. Hence, the push cap 24 is prevented from falling out by the aforementioned projection 25 while the stroke length of the cap is constrained by the projection 31.

In accordance with the fourth embodiment, the stroke length during the clicking operation can be constrained by the device in the clicking portion 21. Here, the projection 31 is not necessarily provided on the whole circumference of the inner peripheral surface of the tail plug 20, but may be provided at intervals.

Figure 6:
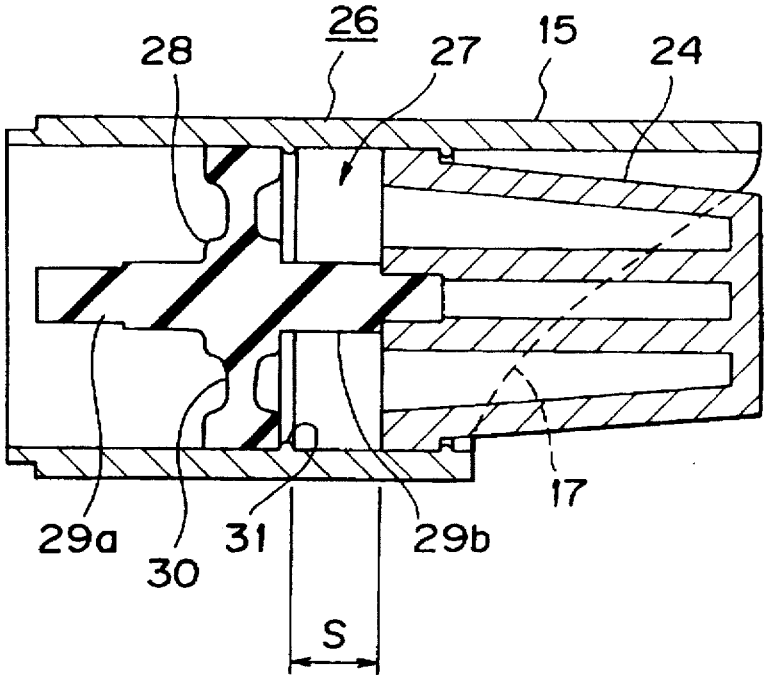
FIG. 6 is a vertical sectional view showing a tail plug in accordance with the fifth embodiment.

Next, the fifth embodiment will be described. As shown in FIG. 6, a clicking portion 27 of the fifth embodiment is formed of a resilient body 28 which is separated from the tail plug body. This resilient body 28 corresponds to the above thin wall 22 and a pair of front and rear ribs 23a and 23b described heretofore. The resilient body 28 is composed of a pair of front and rear ribs 29a and 29b and a thin wall 30 shaped in annular form. The resilient body 28 is composed of rubber material such as elastomer etc., and is integrally formed with a tail plug 26 composed of polypropylene or the like, by means of the bi-color molding machine or the like.

Also in this fifth embodiment, the inner peripheral wall of the tail plug 26 is formed with the projection 31 which the front end of the push cap 24 abuts when the valve rod 6 is moved forward by the predetermined stroke length S. Accordingly, for the clicking portion 27 thus formed, it is possible to constrain the stroke length during the clicking operation, as in the above fourth embodiment.

In accordance with the invention described heretofore as to the embodiments, it is possible to improve the sliding performance of the valve rod and the durability of the clicking portion in the liquid applicators such as writing implements, cosmetic applicators and the like. Further, it is possible to prevent the applying piece from being thrust out by the valve rod. Moreover, the supplying amount of the applying liquid can be exactly controlled to thereby prevent an excessive flow of the applying liquid.

The above first through fifth embodiments are preferable modes of the invention but these embodiment should not limit the technical scope of the invention. As to the synthetic resin material of the barrel cylinder 1 shown in these embodiments, a soft resin is preferably used.

Next, description will be made on variations of the tail clicking portion used in the applicators described heretofore.

Figure 7:
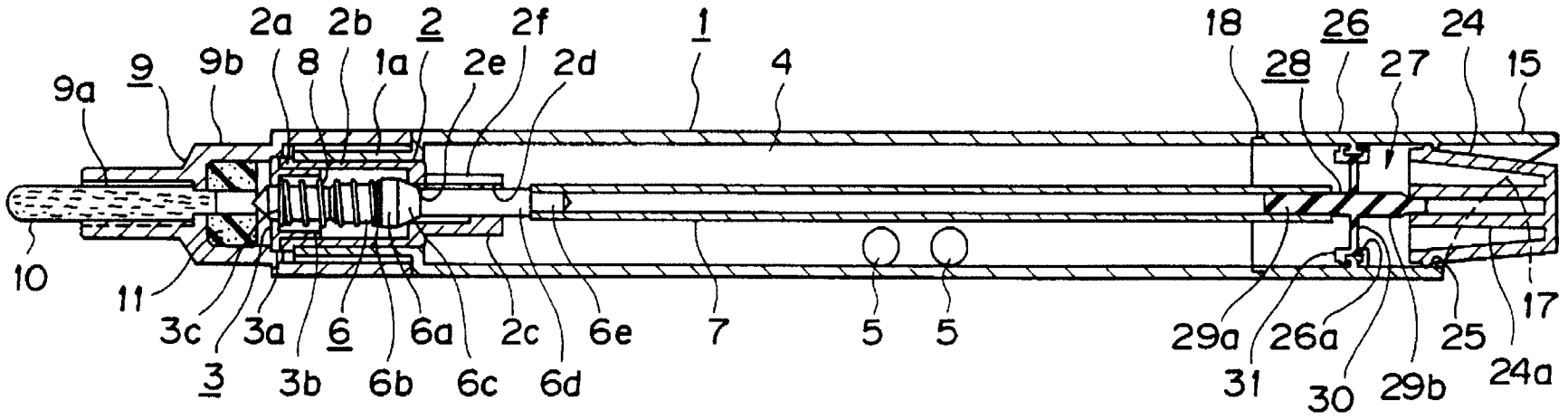
FIG. 7 is a vertical sectional view showing a writing implement in accordance with the sixth embodiment.

Initially, FIG. 7 shows a writing implement having a tail clicking structure as the sixth embodiment. The overall configuration of the writing implement is almost the same with that shown above with reference to FIG. 1. Therefore, the corresponding components will be allotted with the same reference numerals and the repeated description will be omitted.

Next, a clicking portion 27 as a main part in the mode of the sixth embodiment will be described hereinbelow.

As shown in FIG. 7, the clicking portion 27 is formed in a tail barrel 26 fitted to the rear end of the barrel cylinder 1. The clicking portion 27 includes: a resilient body 28 which seals the tail barrel 26 and can restorably be deformed during clicking operations; a push cap 24 which is connected to the rear face of the resilient body 28 and is able to slide back and forth behind the resilient body 28 along the inner peripheral surface of the tail barrel 26.

The tail barrel 26 is a synthetic resin molding which is integrally formed by injection molding and is composed of:

a fixing portion 18 having a substantially cylindrical form to be inserted into the rear opening of the barrel cylinder 1; and a cover portion 15 provided as the rear part in order to prevent malfunctions of the clicking portion 27. The peripheral wall of the cover portion 15 is formed with a cutaway portion 17 opened rearward to allow the user's finger to be fitted. That is, the user is able to perform the clicking operation by avoiding the cover portion 15 and placing the finger in the space created by the cutaway portion 17. Here, the tail barrel 26 is attached to the rear end opening of the barrel cylinder 1 by a fixing means such as press-fitting, fusing or the like.

A projected portion 26*a* is integrally formed inwardly from the entire circumference on the inner peripheral surface (as an example of the inner peripheral surface of a tail end) of the tail barrel 26. This projected portion 26*a* has bent portions formed on both sides along the axial direction (both the forward and backward) in the top part thereof. The projected portion 26*a* has a roughly T-shaped cross-section.

Figure 8:
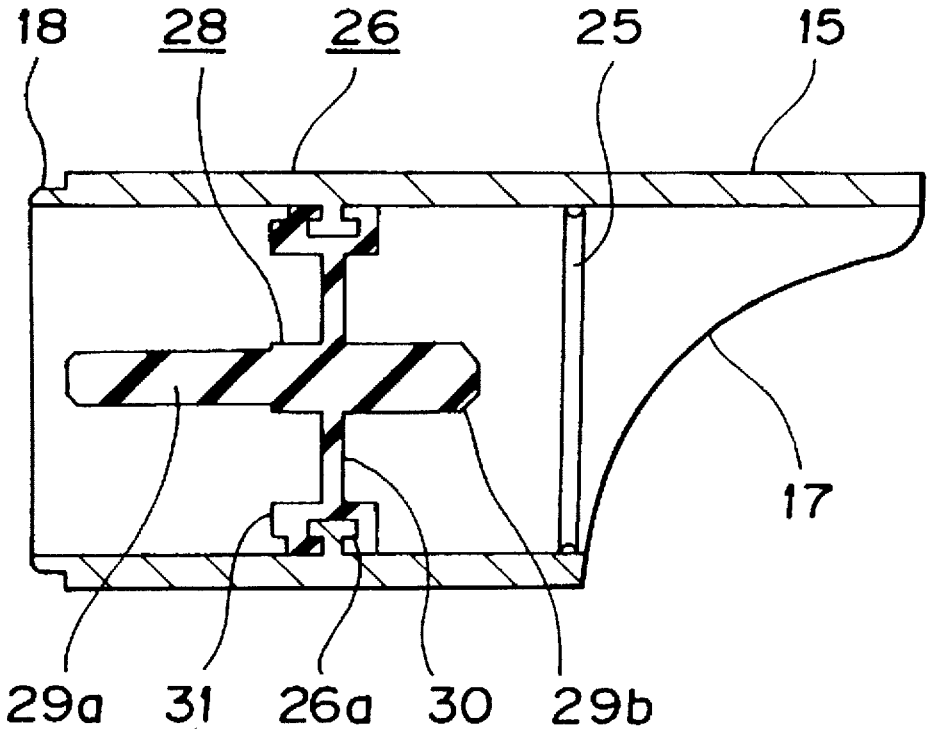
FIG. 8 is a vertical sectional view showing a tail barrel and a resilient body in accordance with the sixth embodiment.

The resilient body 28 is composed of a disc-like thin wall 30 spreading in the radial direction of the barrel cylinder 1, a pair of bar-shaped, front and rear ribs 29*a* and 29*b* integrally formed in the substantial center of the disc-like thin wall 30, and an outer peripheral part 31 formed so as to hermetically grip the projected portion 26*a*. The resilient body 28 is formed inside the tail barrel 26 after the molding of the tail barrel 26, as shown in FIG. 8, by means of the bi-color molding machine using a resilient material which is dissimilar from that of the tail barrel. The resilient material 28 is made up of a rubber material such as elastomer etc.

The push cap 24 is a molding article which, as shown in FIG. 7, is tapered or somewhat reduced in its diameter toward the rear end and has an inner pipe-like rib 24*a*. The push cap 24 is held inside the tail barrel 26 by a projection 25 which is formed on the inner peripheral surface of the cover portion 15 whilst the rib 24*a* is being fitted with the rib 29*b*. The rib 29*a* on the front side of the thin wall 30 is projected toward the ink reservoir 4 and connected to the rear end of the small-diameter pipe 7.

Figure 9:
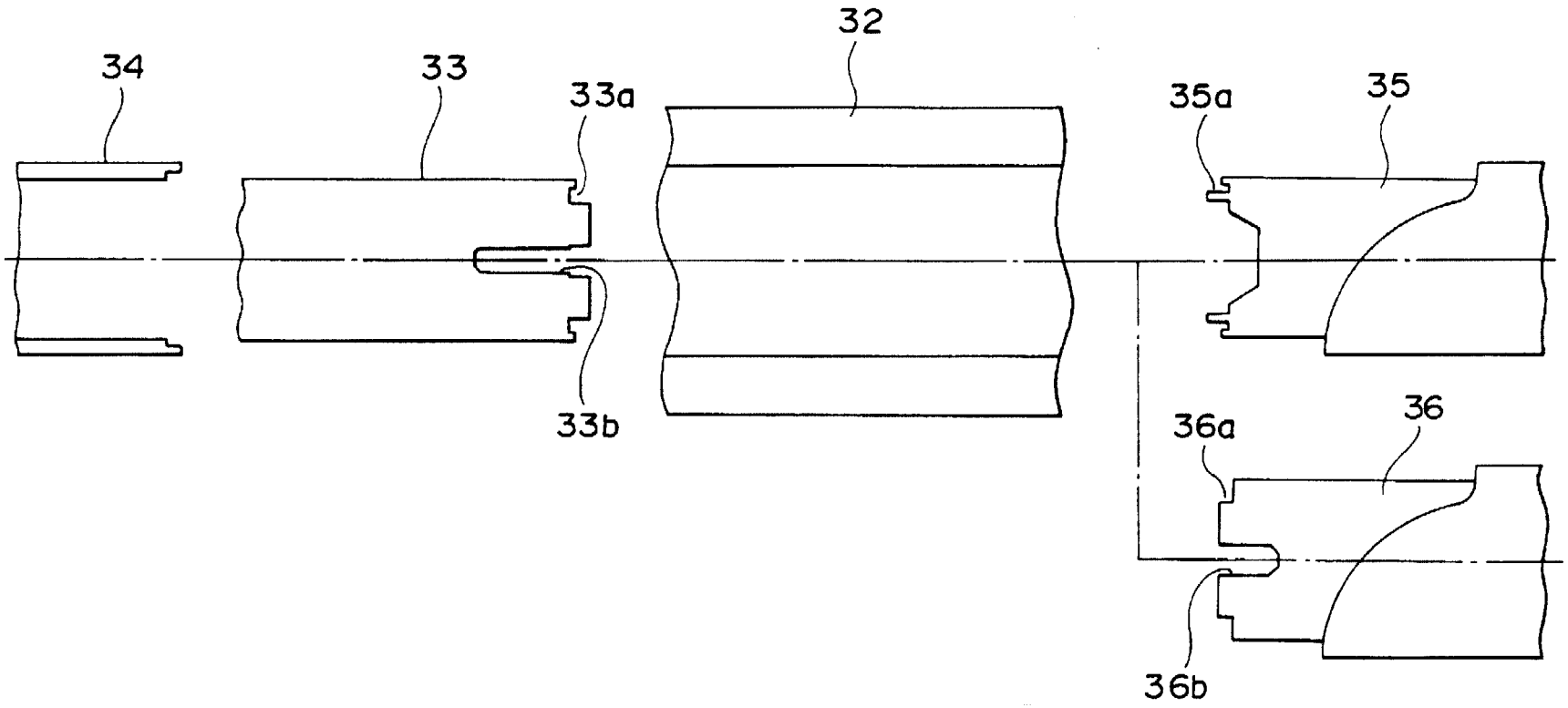
FIG. 9 is an exploded sectional view showing molds of a tail barrel and a resilient body in accordance with the sixth embodiment.
Figure 10:
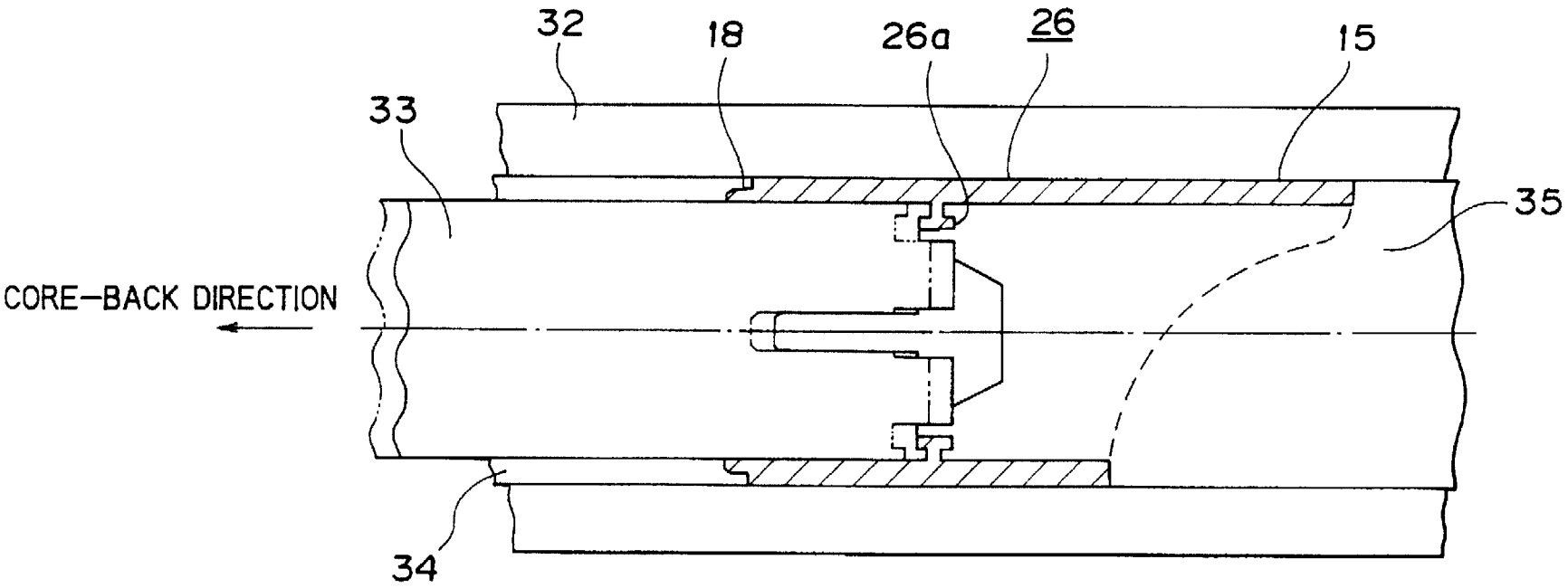
FIG. 10 is a sectional view showing the assembly arrangement of molds of a tail barrel in accordance with the sixth embodiment.

Referring now to FIGS. 9 and 10, description will be made on the molding process for the tail barrel 26 and the resilient body 28 which are produced as a bi-color molding article. This process of molding uses, as shown in FIG. 9, a die body 32 for forming the outer peripheral surface of the tail barrel 26, a movable core 33 used for molding both the tail barrel 26 and the resilient body 28, a sleeve 34 which is fitted on the outer periphery of the movable core 33 to form the fixing portion 18 of the tail barrel 26, and a tail barrel-forming core 35 used in combination with the movable core 33 to form the tail barrel 26 only, and a resilient body-forming core 36 used in combination with the movable core 33 to form only the resilient body 28 after the tail barrel 26 has been formed.

Initially, as shown in FIG. 9, the movable core 33 and sleeve 34 are inserted into the die body 32 from one side (from the left side in FIG. 9) while the tail barrel-forming core 35 is fitted into the die body 32 from the other side (from the right side in FIG. 9). In this arrangement, a closed space for forming the tail barrel 26 is created by the die body 32, sleeve 34, movable core 33 and tail barrel-forming core 35, as shown in FIG. 10. In this closed space, the space section having the roughly T-shaped cross-section for forming the projected portion 26*a* is defined by the combination of recessed-and-projected portions 33*a* and 35*a* formed in the movable core 33 and the tail barrel-forming core 35, respectively (see FIG. 9). As the synthetic resin material is injected into the mold thus arranged, a molding of the tail barrel 26 as shown in FIG. 10, made of the synthetic resin can be obtained.

Next, molding of the resilient body 28 is performed. Before the molding, the movable core 33 is set back to the equivalent distance of the thickness of the resilient body 28 to be made, as shown in imaginary lines in FIG. 10 (the core-back step). At the same time, the tail barrel-forming core 35 is removed whilst the molding of the tail barrel 26 is being left inside the body die 32, and the resilient body-forming core 36 (see FIG. 9) is fitted into place. The fitting of the resilient body-forming core 36 creats a space section for forming the thin wall 30 of the resilient body 28. At the same time, a space section for forming the outer peripheral part 31 of the resilient body 28 is defined around the projected portion 26*a* by the combination of the recessed-and-projected portion 33*a* of the movable core 33 and a recessed portion 36*a* of the resilient body-forming core 36. Further, a circular bore 33*b* in the movable core 33 and another circular bore 36*b* in the resilient body-forming core 36 define the space sections for forming the front and rear ribs 29*a*, 29*b*, respectively. As the thus formed closed space consisting of these space sections is filled up with the resilient material, the resilient body 28 is formed inside the molding of the tail barrel 26, with a dissimilar material in such a feature that the outer peripheral part 31 hermetically grips the projected portion 26*a*.

In accordance with the sixth embodiment thus configurated, when the push cap 24 of the clicking portion 27 is clicked in the axial direction to deform the thin wall 30, the small-diameter pipe 7 is pressed forward. The advance of the small-diameter pipe 7 causes the valve rod 6 to move forward as pressing the valve spring 8 whilst it is being supported by the supporting hole 2*d* of the valve seat 2 and the guide hole 3*c* of the spring receiver 3. As the valve rod 6 moves forward, the stepped portion 6*c* of the valve rod 6 is separated from the front opening rim of the valve hole 2*e* of the valve seat 2. By the release of the valve and the decrease of the volume of the ink reservoir 4 due to the deformation of the thin wall 30, the ink inside the ink reservoir 4 flows into the large-diameter tubular portion 2*b* of the valve seat 2 through the opening 2*f* and valve hole 2*e*. The inflow of ink is supplied through the gap between the guide hole 3*c* of the spring receiver 3 and the front end of the valve rod 6 and the sponge piece 11 to the pen tip 10.

Since in the tail-clicking structure of the sixth embodiment, the resilient body 28 which deforms during the clicking operation is separately formed from the barrel cylinder 1, the material and the wall thickness of the barrel cylinder 1 will not be affected, thus achieving easy handling performaces for the clicking operation. That is, the resilient body 28 as to be the deforming portion of clicking portion 27 can be formed of an easily deformable elastic material and molded in the form of easily deforming shape. Therefore, it is possible to achieve easy handling of the clicking portion 27 without degrading the barrel cylinder 1.

Further, since the resilient body 28 is formed so that the outer peripheral part 31 hermetically grips the projected portion 26*a*, the resilient body 28 will not be removed from the projected portion 26*a* even when an excessive pressure is exerted during clicking. Accordingly, it is also possible to improve the durability of the clicking portion 27 against clicking operations. Moreover, since the outer peripheral part 31 of the resilient body 28 comes into hermetic contact with the projected portion 26*a*, it is possible to reliably seal the ink inside the ink reservoir 4.

Figure 11:
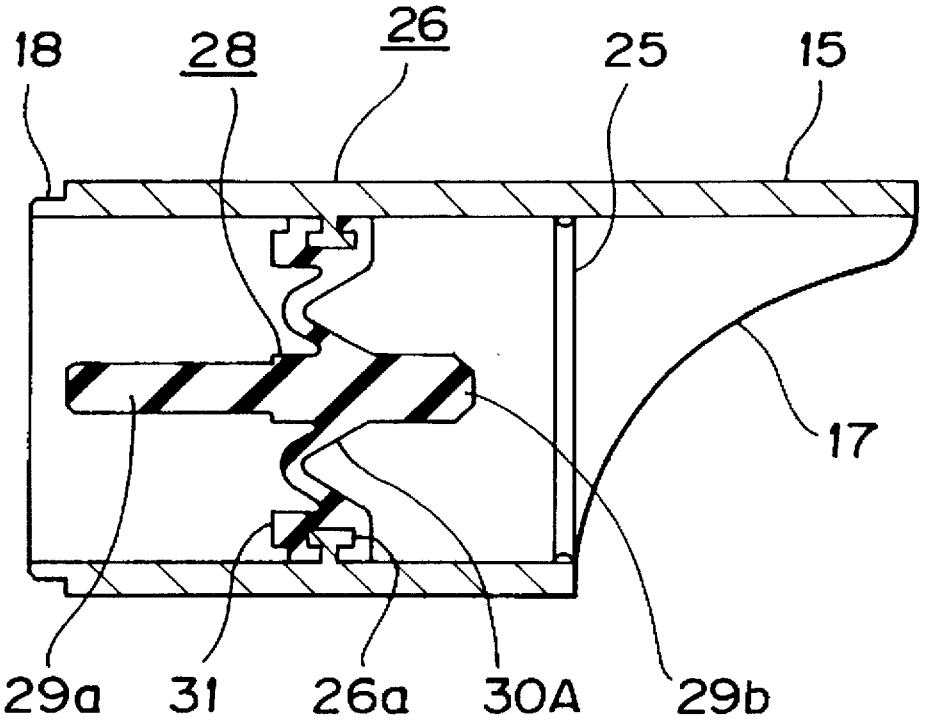
FIG. 11 is a vertical sectional view showing a tail barrel and a resilient body in accordance with a variational example of the sixth embodiment.
Figure 12:
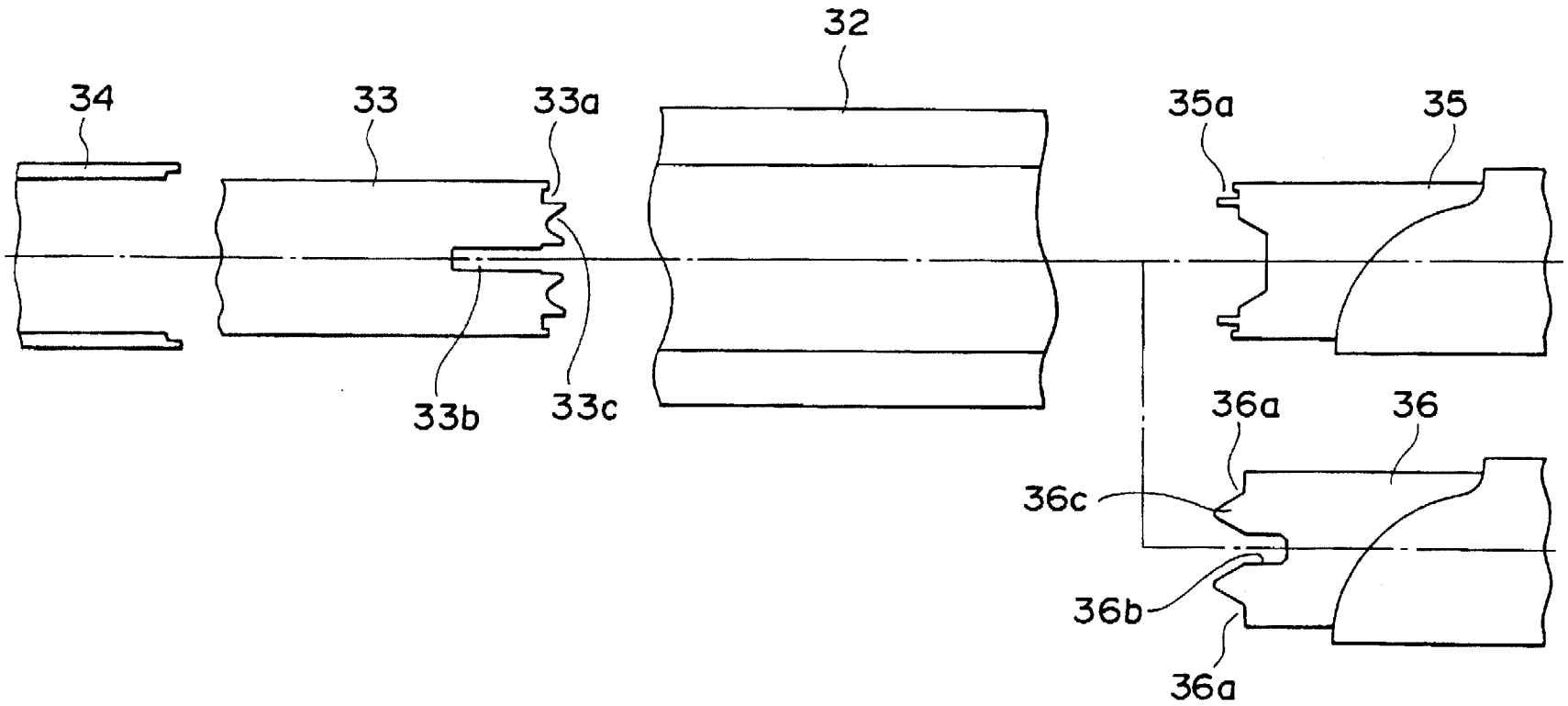
FIG. 12 is an exploded sectional view showing molds of a tail barrel and a resilient body in accordance with a variational example of the sixth embodiment.
Figure 13:
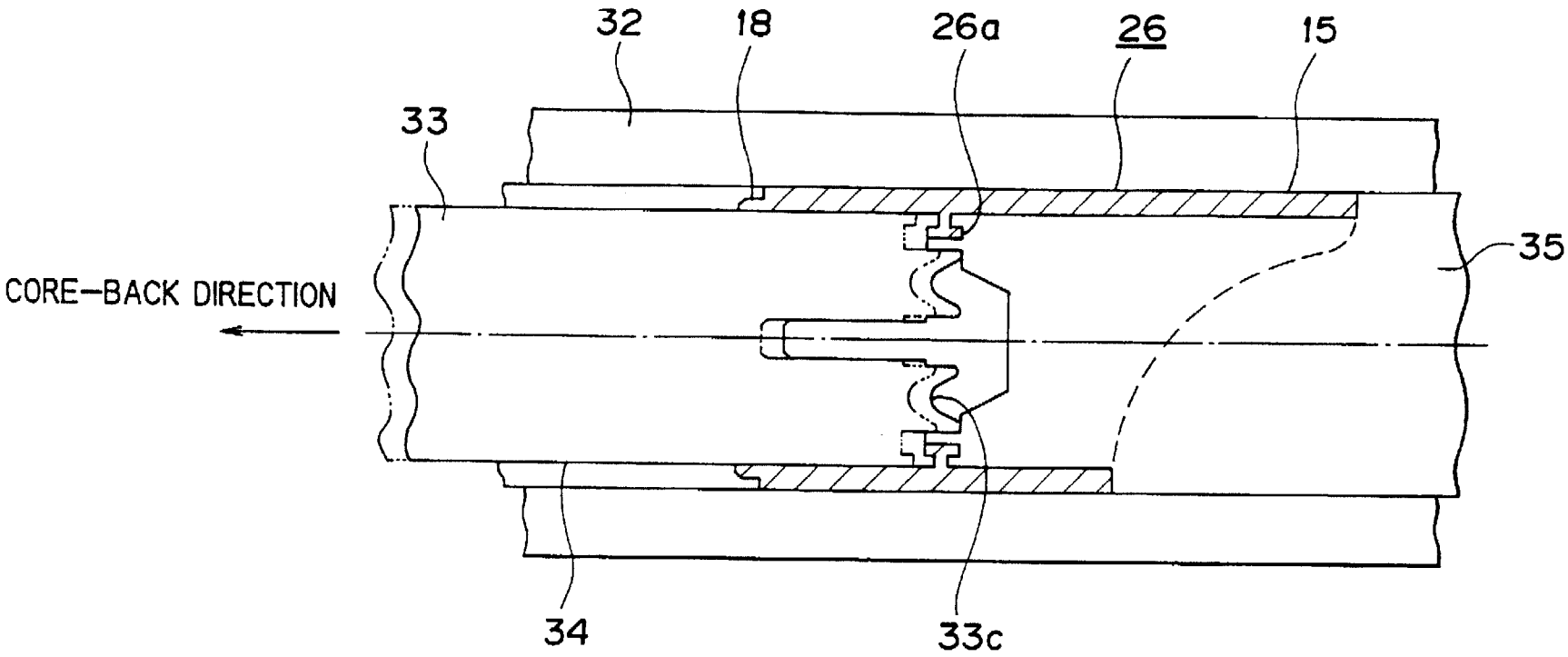
FIG. 13 is a sectional view showing the assembly arrangement of molds of a tail barrel in accordance with a variational example of the sixth embodiment.

It is noted that the sixth embodiment is a mere preferred mode of the invention and the technical scope of the invention should not be limited by the embodiment. For example, the thin wall of the resilient body 28 should not necessarily be disc-shaped like the thin wall 30 but may be formed of V-shaped (in its section) bending thin wall 30A as shown in FIG. 11. In the case that the resilient body 28 with the thin wall 30A is molded, the movable core 33 is formed with an annular trough portion 33*c* while the resilient body-forming core 36 is formed with an annular crest portion 36*c* mating the trough portion 33*c* as shown in FIGS. 12 and 13 so that a space section for molding the thin wall 30A is created between these annular trough and crest portions 33*c* and 36*c*.

The shape of the thin wall 30A lends itself to increasing the maximum amount of flexibility of the resilient body 28 and therefore increases the stroke length of clicking. Further, since this structure inhibits stress from building up in the outer peripheral part 31 during clicking operations, it is also possible to further improve the durability of the clicking portion 27.

In the sixth embodiment, although the projected portion 26*a* is formed on the tail barrel 26 which is separate from the barrel cylinder 1, this structure should not limit the invention. That is, it is also possible to form a clicking structure by molding the projected portion on the inner peripheral surface at the tail end of the barrel cylinder 1 itself and molding the resilient body 28 inside the barrel cylinder 1 so as to grip the projected portion, using a dissimilar material.

Figure 14:
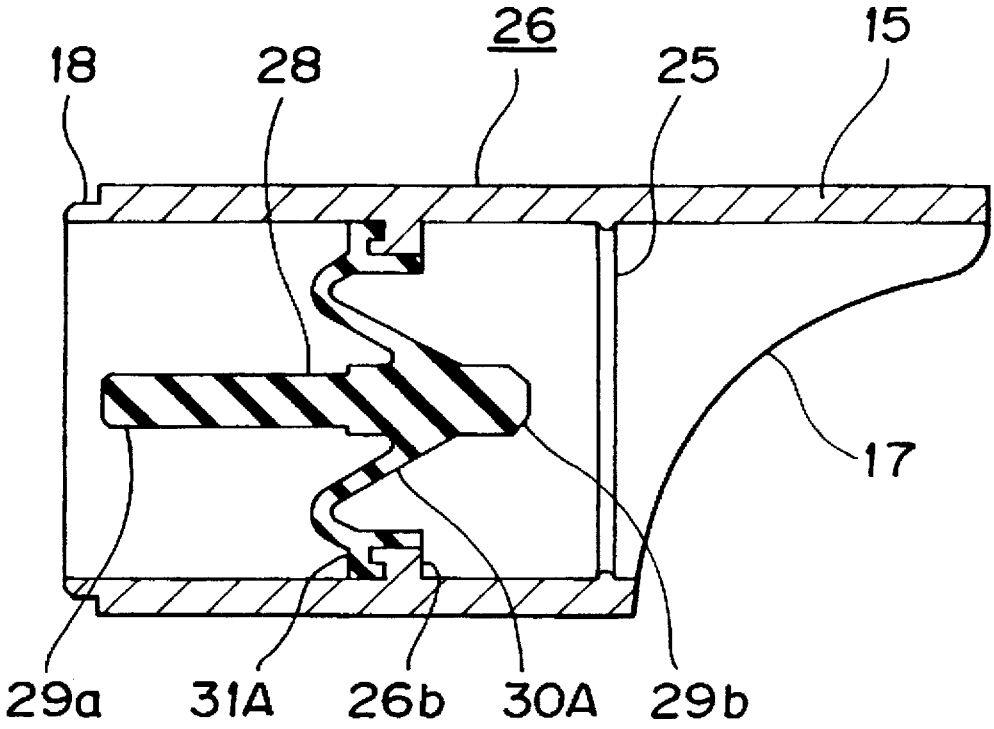
FIG. 14 is a vertical sectional view showing a tail barrel and a resilient body in accordance with another variational example of the sixth embodiment.

The projected portion according to the invention should not necessarily be formed in the roughly T-shape in its cross-section. It is also possible to form a projected portion 26*b* shown in FIG. 14, which has a roughly L-shaped cross-section. That is, the projected portion 26*b* can be formed of an annular rib which projects inwardly from the inner peripheral surface of the tail barrel 26 with an upper bending portion toward only one side in the axial direction. Further, as shown in FIG. 14, the rim of the resilient body 28 may be formed of a outer peripheral part 31A which grips the projected portion 26*b* on only the side toward which the bending portion extends. This structure also lends itself to eliminating the aforementioned core-back process.

Next, the molding process of the bi-color molding composed of the tail barrel 26 and resilient body 28 shown in FIG. 14 will be described with reference to FIGS. 15 and 16. This process of molding uses the die body 32, a fixed core 37 used for molding both the tail barrel 26 and the resilient body 28, a sleeve 38 which is fitted on the outer periphery of the fixed core 37 to form a cutaway 17 of the cover portion 15, a tail barrel-forming core 39 used in combination with the fixed core 37 to form the tail barrel 26 only, and a resilient body-forming core 40 used in combination with the fixed core 37 to form only the resilient body 28.

Figure 15:
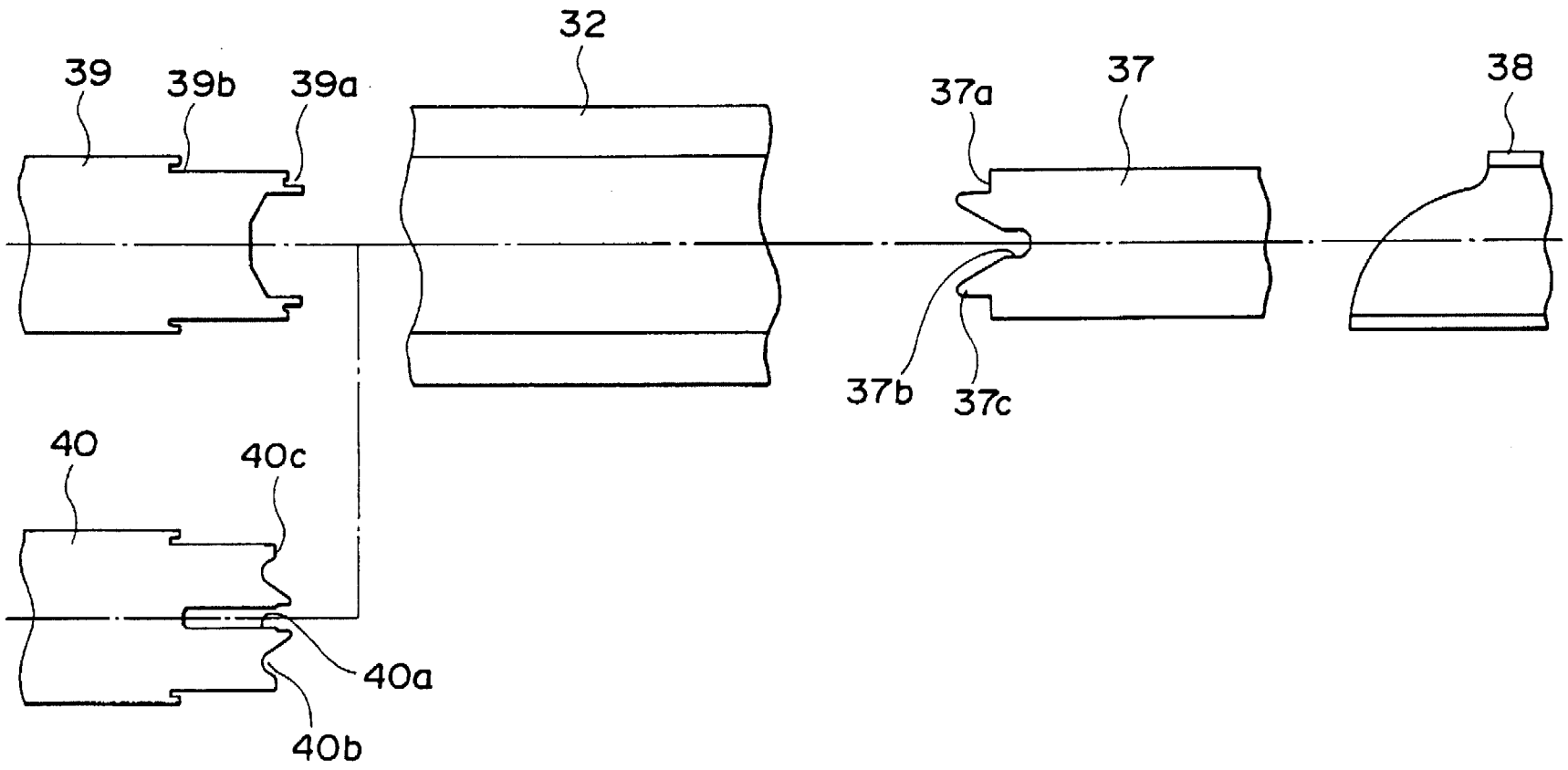
FIG. 15 is an exploded sectional view showing molds of a tail barrel and a resilient body in accordance with another variational example of the sixth embodiment.
Figure 16:
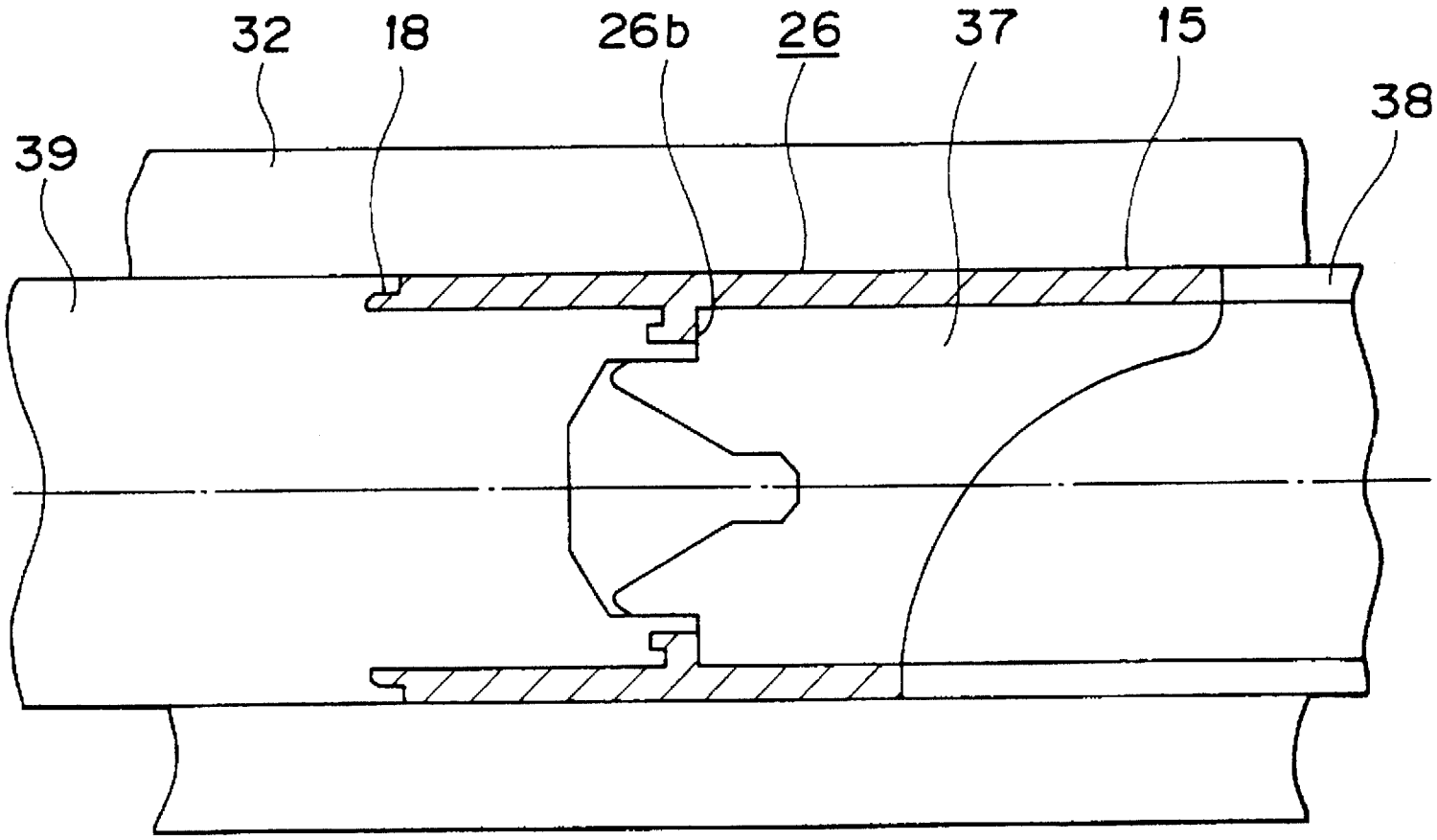
FIG. 16 is a sectional view showing the assembly arrangement of molds of a tail barrel in accordance with another variational example of the sixth embodiment.

Initially, as shown in FIG. 15, the fixed core 37 and sleeve 38 are inserted into the die body 32 from one side (from the right side in FIG. 15) while the tail barrel-forming core 39 is fitted into the die body 32 from the other side (from the left side in FIG. 15). In this arrangement, a closed space for forming the tail barrel 26 is created by the die body 32, sleeve 38, fixed core 37 and tail barrel-forming core 39, as shown in FIG. 16. In this closed space, the space section having the roughly L-shaped cross-section for forming the projected portion 26*b* is defined by the combination of a small-diameter stepped portion 37*a* (see FIG. 15) formed on the outer circumference at the front end of the fixed core 37 and recessed-and-projected portion 39*a* (see FIG. 15) formed in the tail barrel-forming core 39. As the synthetic resin material is injected into the mold thus arranged, a molding of the tail barrel 26 as shown in FIG. 16, made of the synthetic resin can be obtained. In this case, the fixing portion 18 of the tail barrel 26 is formed by an annular groove 39*b* in the tail barrel-forming core Next, the resilient body 28 is molded. In this case, without setting the fixed core 37 back, the fixed core 37 as well as the molding article of the tail barrel 26 is left inside the die body 32. On the other hand, the tail barrel-forming core 39 is removed and the resilient body-forming core 40 is fitted into place (see FIG. 15). As the resilient body-forming core 40 is inserted, a space section for forming a pair of the front and rear ribs 29*a* and 29*b* is created by circular bores 37*b* and 40*a* formed in the fixed core 37 and the resilient body-forming core 40, respectively. At the same time, a space section for forming the roughly V-shaped bending thin wall 30A of the resilient body 28 is created by a crest portion 37*c* of the fixed core 37 and a trough portion 40*b* of the resilient body-forming core 40. In addition to these spaces, a space for forming the outer peripheral part 31A of the resilient body 28 is formed around the projected portion 26*b* by the combination of the small-diameter stepped portion 37*a* of the fixed core 37 and an annular end face 40*c* formed outside the trough portion 40*b* of the resilient body-forming core 40. As the thus formed closed space consisting of these space sections is filled up with the resilient material, the resilient body 28 is formed inside the molding of the tail barrel 26, with a dissimilar material in such a feature that the outer peripheral part 31A hermetically grips the inward-facing surface and forward-facing surface of the projected portion 26*b*.

Thus, the molding process of the bi-color molding article shown in FIG. 14 is carried out without performing the core-back of the mold. This feature is advantageous to simplifying the structure of the metal mold thus resulting in reduction of the cost of manufacturing. Here, in the bi-color molding article shown in FIG. 14, the projected portion 26*b* is bent forward only and the outer peripheral part 31A of the resilient body 28 is made to seal the inward-facing surface and forward-facing surface of the projected portion 26*b*, so that impacts generated by the agitating ball 5 may be exerted on the projected portion 26*b* through the outer peripheral part 31A. In contrast, it is also possible to bend the projected portion 26*b* only in the backward direction and make the outer peripheral part 31A of the resilient body 28 seal the inward-facing surface and rearward-facing surface of the projected portion 26*b*.

Thus, in accordance with the sixth embodiment of the invention, in the tail clicking structure of the liquid applicator such as writing implements, cosmetic applicators etc., it is possible to set the pressure to be exerted on the clicking portion low enough to be suitable for the normal use, without affecting the material and wall thickness of the barrel cylinder. It is also possible to improve the durability of the clicking portion against clicking operations. Further, it is also possible to surely seal the applying liquid inside the barrel cylinder.

Next, another variational example of the tail clicking structure of the invention will be explained.

Figure 17:
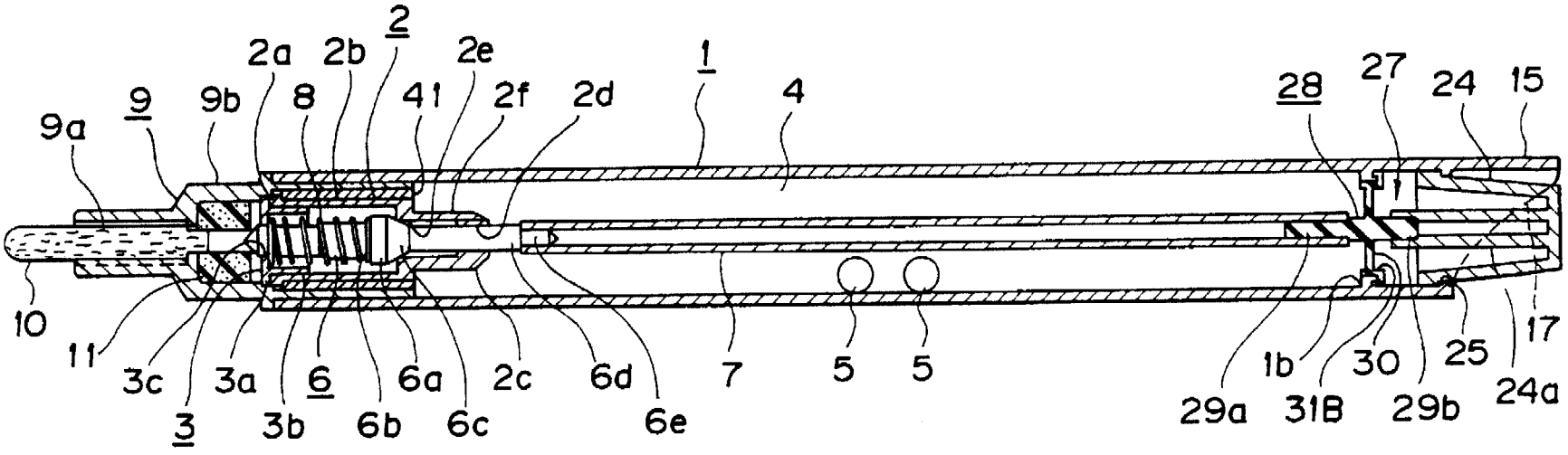
FIG. 17 is a vertical sectional view showing a writing implement in accordance with the seventh embodiment.

FIG. 17 shows a writing implement having a tail clicking structure as the seventh embodiment. The overall configuration of main parts of the writing implement is the same with that shown in FIG. 1, and the operation etc. of the clicking portion 27 is generally the same with that of the sixth embodiment described above. Therefore, the corresponding components are allotted with the same reference numerals and the repeated description will be omitted.

Initially, the difference in the part around the valve seat 2 between FIG. 17 and FIG. 1 is that the small-diameter mouth portion 1*a* in FIG. 1 is replaced with a spacer 41 interposed.

That is, the valve seat 2 is composed of: a flange portion 2*a* formed at the front end; a large-diameter tubular portion 2*b* positioned inside the mouth portion of the barrel cylinder 1; a small-diameter tubular portion 2*c* projected out from the rear end of the large-diameter tubular portion 2*b* into the ink reservoir 4; a supporting hole 2*d* which is formed through the rear wall of the small-diameter tubular portion 2*c* to slidably support the small-diameter portion 6*d* of the valve rod 6; a valve hole 2*e* for the transference between the large-diameter tubular portion 2*b* and the small-diameter tubular portion 2*c;* and an opening 2*f* which is formed on the side wall of the small-diameter tubular portion 2*c*.

A front barrel 9 is fixed on the inner peripheral surface of the mouth portion of the barrel cylinder 1, and the spacer 41 is interposed between the inner peripheral surface of the front barrel 9 and the outer peripheral wall of the large-diameter tubular portion 2*b*. The front end face of the spacer 41 and the front barrel 9 sandwich the flange portions 2*a* and 3*a* of the valve seat 2 and spring receiver 3 inside the front barrel 9. A plurality of ribs 9*a* which are radially and inwardly projected are formed at positions required (positioned 120° apart on the circumference) on the inner surface of the center hole of the front barrel 9.

Next, the clicking portion 27 as a main part of the seventh embodiment will be described.

As shown in FIG. 17, a clicking portion 27 is formed in a tail portion of the barrel cylinder 1. The clicking portion 27 includes: a resilient body 28 which seals the tail end of the barrel cylinder 1 and can restorably be deformed during clicking operations; a push cap 24 which is connected to the rear face of the resilient body 28 and is able to slide back and forth behind the resilient body 28 along the inner peripheral surface of the barrel cylinder 1.

In this case, the main difference from the arrangement of the tail end portion in the sixth embodiment is that the barrel cylinder 1 is integrally formed up to the tail portion and a projected portion 1*b* is formed inside the barrel cylinder 1. That is, the tail barrel 26 having the projected portion 26*a* or 26*b* shown in the sixth embodiment is omitted.

That is, the barrel cylinder 1 is a synthetic resin molding which is integrally formed by injection molding and includes a cover portion 15 provided as the rear part thereof in order to prevent malfunctions of the clicking portion 27. The peripheral wall of the cover portion 15 is formed with a cutaway portion 17 opened rearward to allow the user's finger to be fitted. That is, the user is able to perform the clicking operation by avoiding the cover portion 15 and placing the finger in the space created by the cutaway portion 17.

Provided on inner peripheral surface of the barrel cylinder 1 is the projected portion 1*b* which is integrally formed inwardly from the entire circumference on the inner peripheral surface. This projected portion 1*b* has bent portions formed on both sides along the axial direction (both the forward and backward) in the top part thereof. The projected portion 1*b* has a roughly L-shaped cross-section. The inner peripheral surface which lies ahead of the projected portion 1*b* of the barrel cylinder 1 is so shaped as to allow a movable core 43 (to be referred to herein below) for forming the inner peripheral surface to be separable in the forward direction. In other words, the inner peripheral surface which lies ahead of the projected portion 1*b* of the barrel cylinder 1 is formed with a cylinder surface with an almost substantially identical inside diameter without any stepped portion. As to the fixing means between the front barrel 9 and the barrel cylinder 1, one of the following fixing methods can suitably be selected: the squeezing method whereby the outer peripheral surface of the front barrel 9 is squeezed into the inner peripheral surface of the barrel cylinder 1; the ultrasonic welding method whereby the outer peripheral surface of the front barrel 9 and the inner peripheral surface of the barrel cylinder 1 is bonded; the screwing method whereby a male thread formed on the outer peripheral surface of the front barrel 9 is fitted into the mating female thread formed on the inner peripheral surface of the barrel cylinder 1; and the screwing method whereby a female thread formed on the outer peripheral surface of the front barrel 9 is fitted into the mating male thread formed on the inner peripheral surface of the barrel cylinder 1; and the like.

Figure 18:
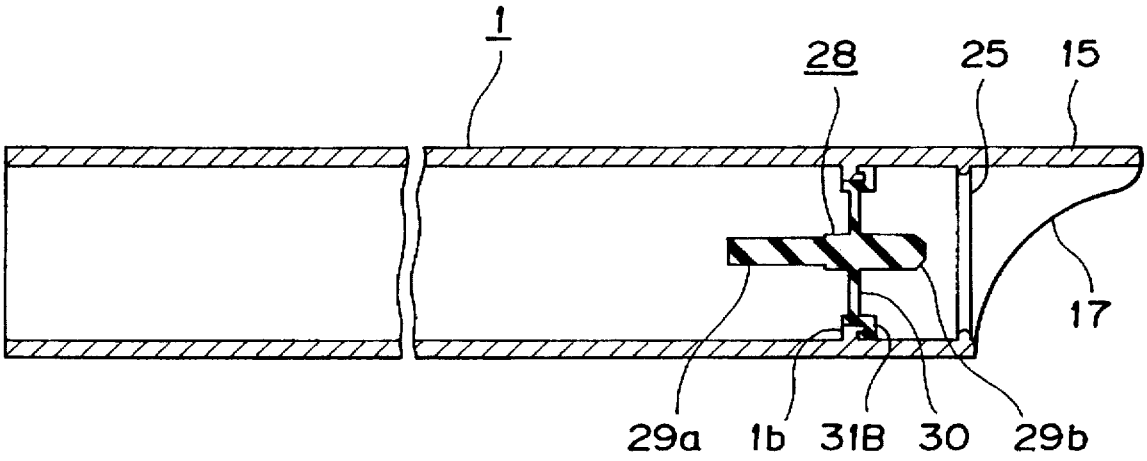
FIG. 18 is a vertical sectional view showing a barrel cylinder and a resilient body in accordance with the seventh embodiment.

The resilient body 28 is composed of a disc-like thin wall disc 30 spreading in the radial direction of the barrel cylinder 1, a pair of bar-shaped, front and rear ribs 29*a* and 29*b* integrally formed in the substantial center of the disc-like thin wall 30, and an outer peripheral part 31B formed so as to hermetically grip the projected portion 1*b*. The resilient body 28 is formed inside the barrel cylinder 1 after the molding of the barrel cylinder 1, as shown in FIG. 18, by means of the bi-color molding machine using a resilient material which is dissimilar from that of the barrel cylinder. The resilient material 28 is made up of a rubber material such as elastomer etc.

The push cap 24 is a molding article which, as shown in FIG. 17, is tapered or somewhat reduced in its diameter toward the rear end and has an inner pipe-like rib 24*a*. The push cap 24 is held inside the barrel cylinder 1 by a projection 25 which is formed on the inner peripheral surface of the cover portion 15 whilst the rib 24*a* is being fitted with the rib 29*b*. The rib 29*a* on the front side of the thin wall 30 is projected toward the ink reservoir 4 and connected to the rear end of the small-diameter pipe 7.

Figure 19:
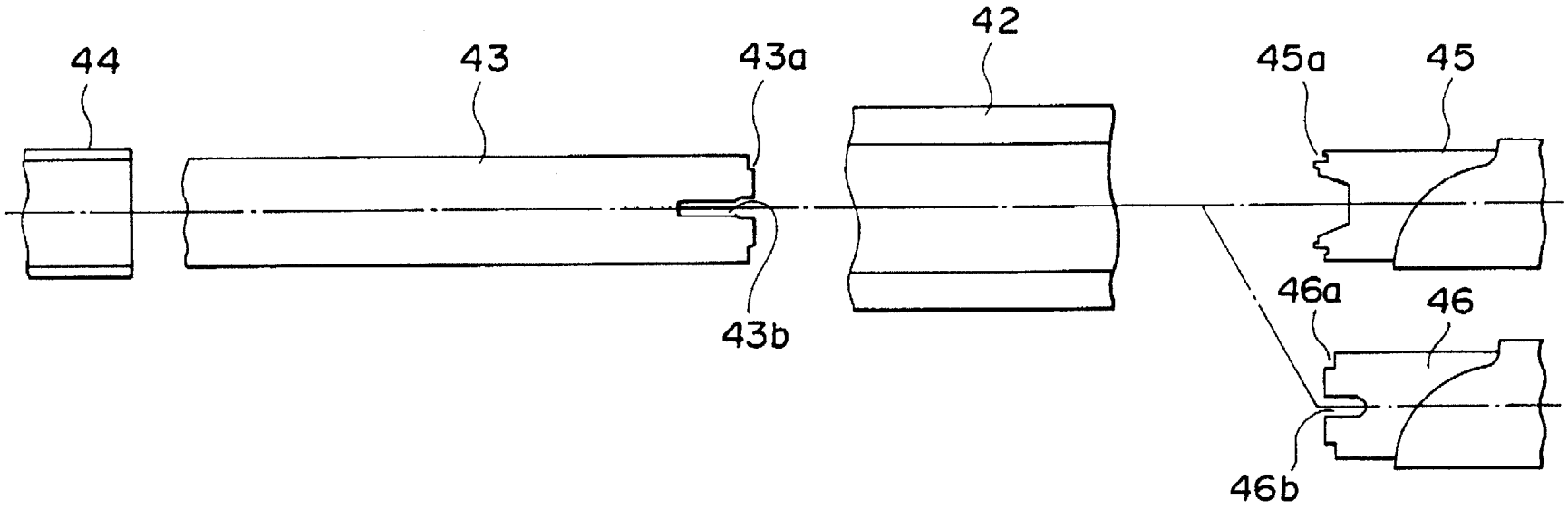
FIG. 19 is an exploded sectional view showing molds of a barrel cylinder and a resilient body in accordance with the seventh embodiment.
Figure 20:
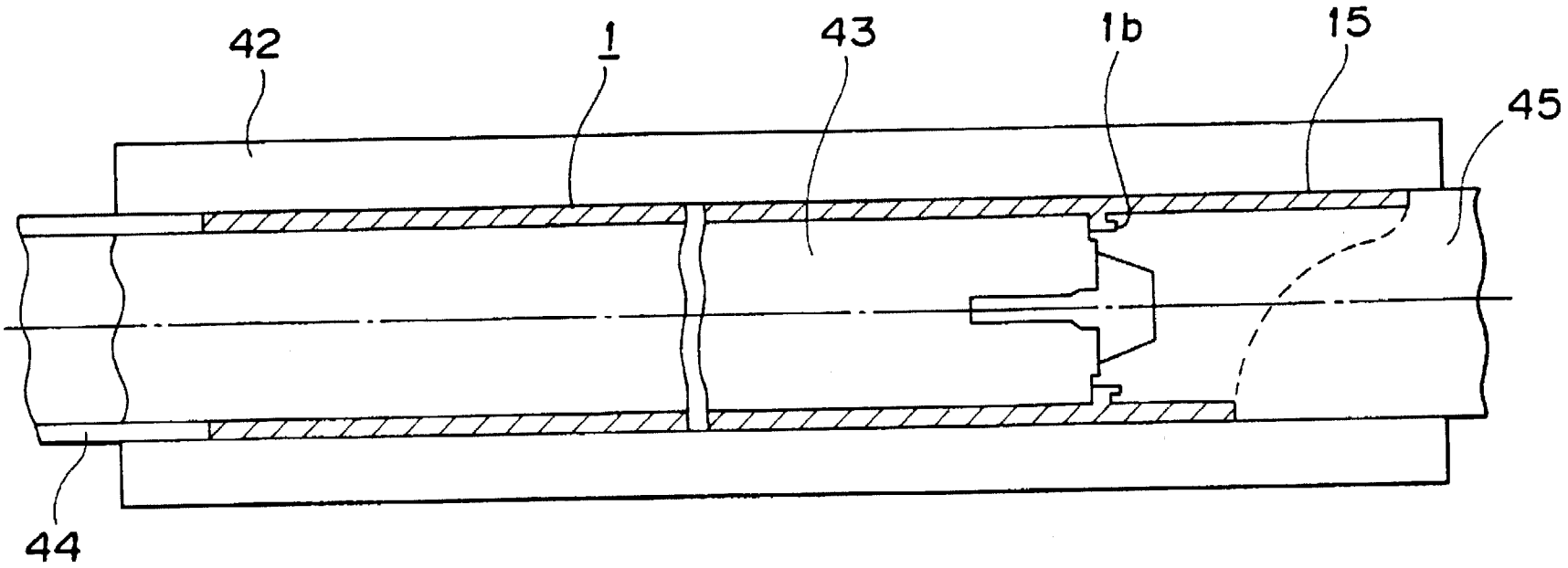
FIG. 20 is a sectional view showing the assembly arrangement of molds of a barrel cylinder in accordance with the seventh embodiment.

Referring now to FIGS. 19 and 20, description will be made on the molding process for the barrel cylinder and the resilient body 28 which are produced as a bi-color molding article. This process of molding uses, as shown in FIG. 19, a die body 42 for forming the outer peripheral surface of the barrel cylinder 1, a movable core 43 used for molding both the barrel cylinder 1 and the resilient body 28, a sleeve 44 which is fitted on the outer periphery of the movable core 43 to form the front end of the mouth portion of the barrel cylinder 1, a barrel cylinder-forming core 45 used in combination with the movable core 43 to form the barrel cylinder 1 only, and a resilient body-forming core 46 used in combination with the movable core 43 to form only the resilient body 28 after the barrel cylinder 1 has been formed.

Initially, as shown in FIG. 19, the movable core 43 and sleeve 44 are inserted into the die body 42 from one side (from the left side in FIG. 19) while the barrel cylinder-forming core 45 is fitted into the die body 42 from the other side (from the right side in FIG. 19). In this arrangement, a closed space for forming the barrel cylinder 1 is created by the die body 42, sleeve 44, movable core 43 and barrel cylinder-forming core 45, as shown in FIG. 20. In this closed space, the space section having the roughly L-shaped cross-section for forming the projected portion 1*b* is defined by the combination of recessed-and-projected portions 43*a* and 45*a* formed in the movable core 43 and the barrel cylinder-forming 45, respectively (see FIG. 19). As the synthetic resin material is injected into the mold thus arranged, a molding of the barrel cylinder 1 as shown in FIG. 20, made of the synthetic resin can be obtained.

Next, molding of the resilient body 28 is performed. Upon the molding of the resilient body 28, the barrel cylinder-forming core 45 is removed whilst the molding of the barrel cylinder 1 is being left inside the die body 42. The resilient body-forming core 46 is fitted into the place of the removed core 45 (see FIG. 19). The fitting of the resilient body-forming core 46 creats a space section for forming the thin wall 30 of the resilient body 28. At the same time, a space section for forming the outer peripheral part 31B of the resilient body 28 is defined around the projected portion **1*b* by the combination of the recessed-and-projected portion 43*a* of the movable core 43 and a recessed portion 46*a* of the resilient body-forming core 46. Further, a circular bore 43*b* in the movable core 43 and another circular bore 46*b* in the resilient body-forming core 46 define the space sections for forming the front and rear ribs 29*a*, 29*b*, respectively. As the thus formed closed space consisting of these space sections is filled up with the resilient material, the resilient body 28 is formed inside the molding of the barrel cylinder 1, with a dissimilar material in such a feature that the outer peripheral part 31B hermetically grips the projected portion 1*b***.

Since the resilient body 28 is formed so that the outer peripheral part 31B hermetically grips the projected portion **1*b*, the resilient body 28 will not be removed from the projected portion 1*b* even when an excessive pressure is exerted during clicking. Accordingly, it is possible to improve the durability of the clicking portion 27 against clicking operations. Further, since the outer peripheral part 31B of the resilient body 28 comes into hermetic contact with the projected portion 1*b*, it is possible to reliably seal the ink inside the ink reservoir 4**.

Further, in the seventh embodiment, since the inner peripheral surface of the barrel cylinder 1 which lies ahead of the projected portion **1*b* is constituted by a cylindrical surface which allows the movable core 43 for forming the inner peripheral surface to be separated forward, it is possible to separate the metal mold by pulling the movable core 43 in the forward direction after the inner peripheral surface of the barrel cylinder 1 has been formed. When the inner periphery of the barrel cylinder 1 and the outer periphery of the front barrel 9 are fixed to each other by the screw fitting, a thread ('forcibly pulling-able thread') which is as thick as to allow the movable core 43 to be removed and can be forcibly pulled, may be formed on the inner peripheral surface of the mouth portion of the barrel cylinder 1. In contrast to this, if the mouth portion of the barrel cylinder 1 is formed with a smaller diameter, a stepped portion will be formed on the inner peripheral surface of the barrel cylinder 1**. Accordingly, the stepped portion forms an undercut which prohibits the separation of the core.

Figure 21:
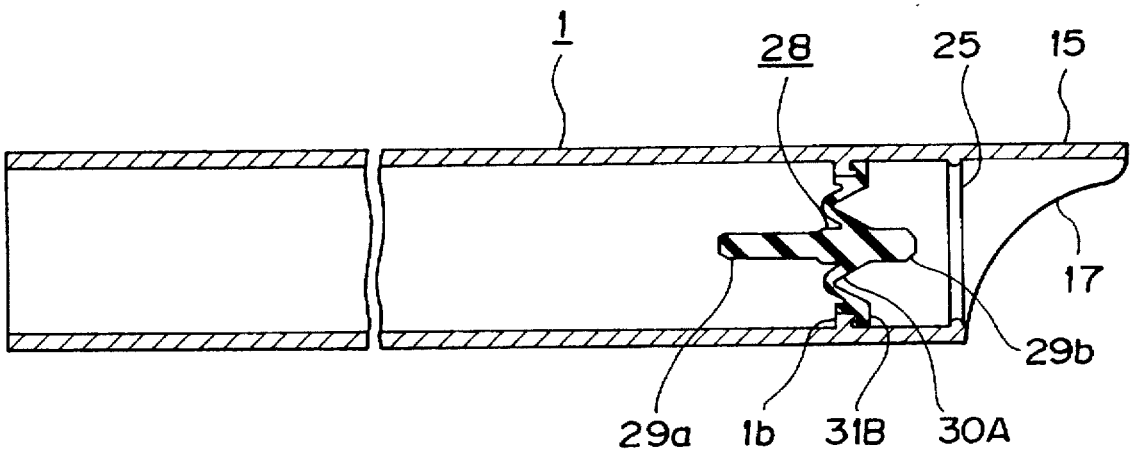
FIG. 21 is a vertical sectional view showing a barrel cylinder and a resilient body in accordance with a variational example of the seventh embodiment.
Figure 22:
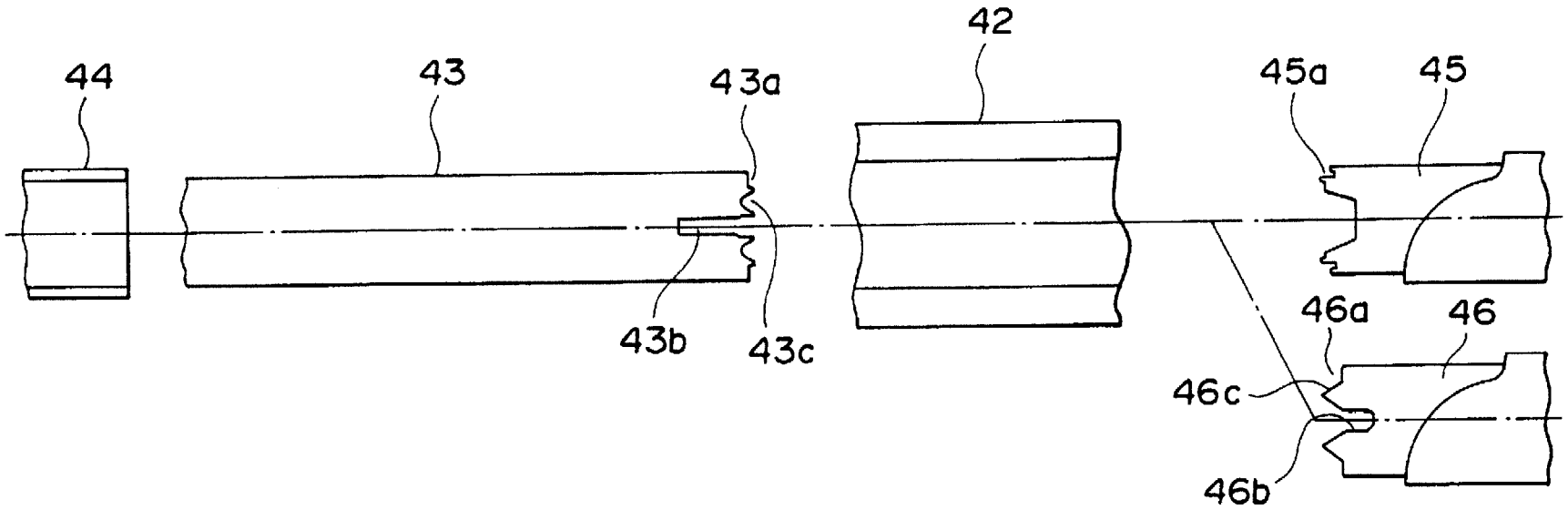
FIG. 22 is an exploded sectional view showing molds of a barrel cylinder and a resilient body in accordance with a variational example of the seventh embodiment.
Figure 23:
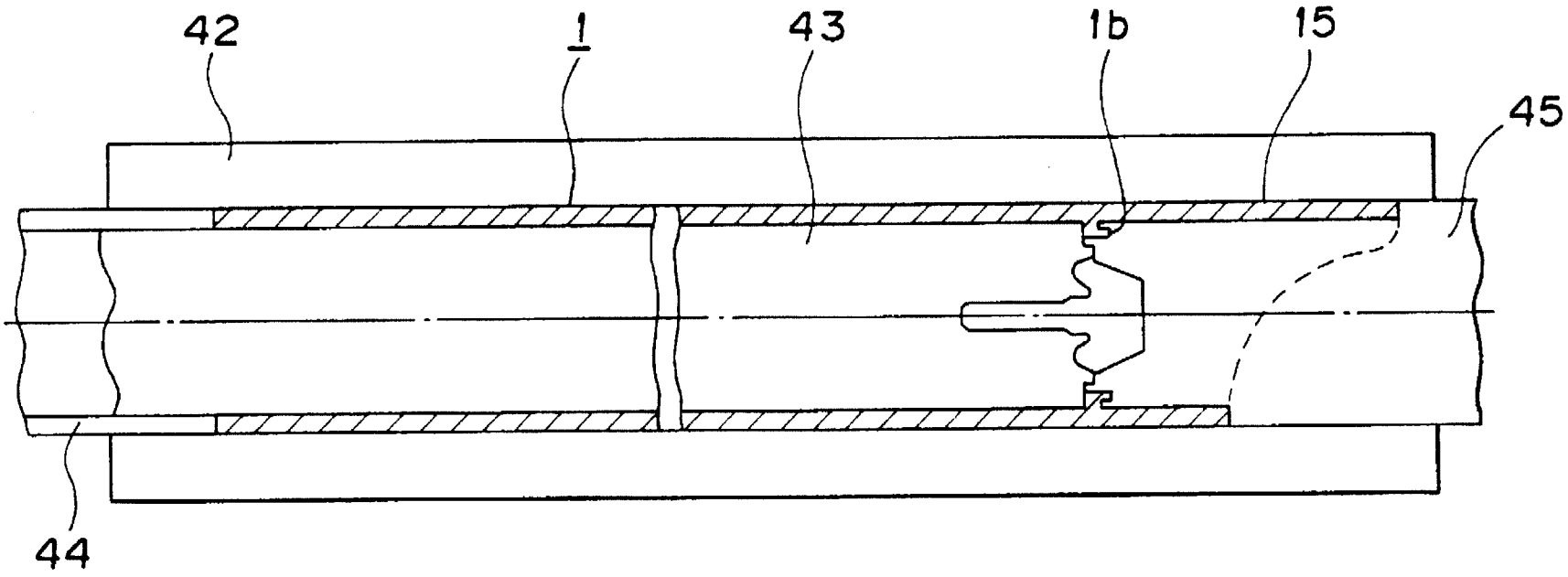
FIG. 23 is a sectional view showing the assembly arrangement of molds of a barrel cylinder in accordance with a variational example of the seventh embodiment.

It is noted that the seventh embodiment is a mere preferred mode of the invention and the technical scope of the invention should not be limited by the embodiment. For example, the thin wall of the resilient body 28 should not necessarily be disc-shaped like the than wall 30 but may be formed of V-shaped (in its section) bending thin wall 30A as shown in FIG. 21. In the case that the resilient body 28 with the thin wall 30A is molded, the movable core 43 is formed with an annular trough portion **43*c* while the resilient body-forming core 46 is formed with an annular crest portion 46*c* mating the trough portion 43*c* as shown in FIGS. 22 and 23 so that a space section for molding the thin wall 30A is created between these annular trough and crest portions 43*c* and 46*c***.

The shape of the thin wall 30A lends itself to increasing the maximum amount of flexibility of the resilient body 28 and therefore increases the stroke length of clicking. Further, since this structure inhibits stress from building up in the outer peripheral part 31B during clicking operations, it is also possible to further improve the durability of the clicking portion 27.

Figure 24:
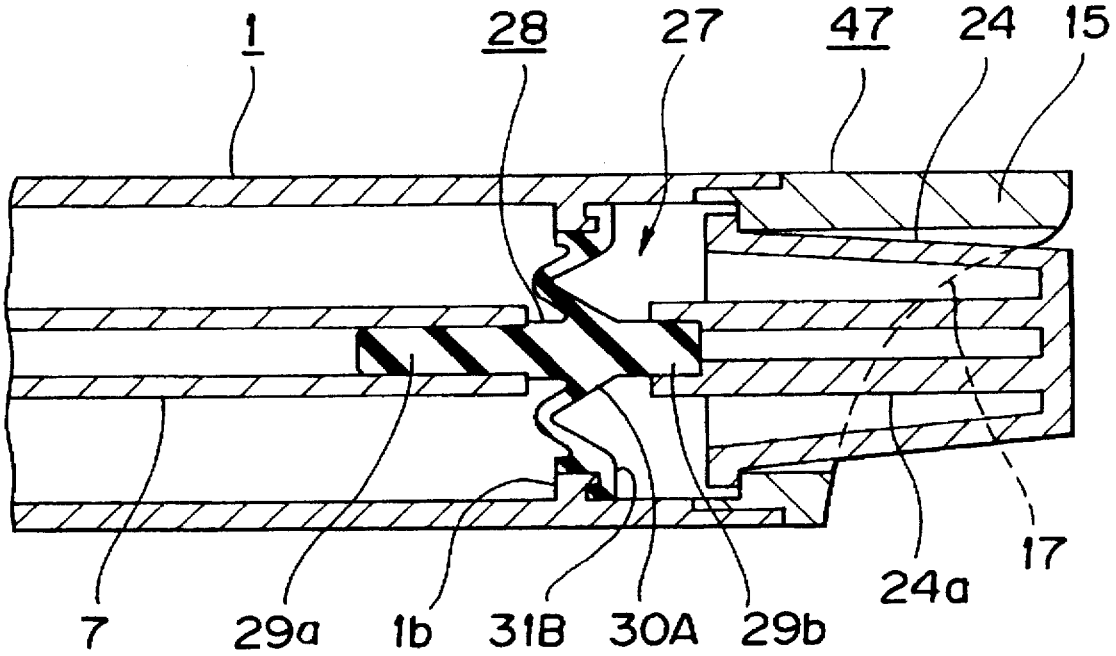
FIG. 24 is a vertical sectional view of a barrel cylinder, a resilient body and a tail barrel in accordance with another variational example of the seventh embodiment.

Although in the above embodiment, the cover portion 16, cutaway 17 and projection 25 are integrally formed on the inner peripheral surface of the tail part of the barrel cylinder 1, the present invention should not be limited by this structure. That is, as shown in FIG. 24, a separate tail barrel 47 having the cover portion 15, cutaway 17 and regulating the rear position of the push cap 24 may be connected to the rear end of the barrel cylinder 1.

Further, the projected portion in the invention will not be limited to one which has a roughly L-shaped cross-section. Specifically, a projected portion which is projected inwardly from the inner peripheral surface of the barrel cylinder and bent only in the axially forward direction in the upper part to form a roughly L-shaped cross-section or bent in the both the axially forward and rearward directions in the upper part to form a roughly T-shaped cross-section.

Thus, in accordance with the seventh embodiment of the invention, in the tail clicking structure of the liquid applicator such as writing implements, cosmetic applicators etc., it is possible to set the pressure to be exerted on the clicking portion low enough to be suitable for the normal use, without affecting the material and wall thickness of the barrel cylinder. It is also possible to improve the durability of the clicking portion against clicking operations. Further, it is also possible to surely seal the applying liquid inside the barrel cylinder.

Figure 25:
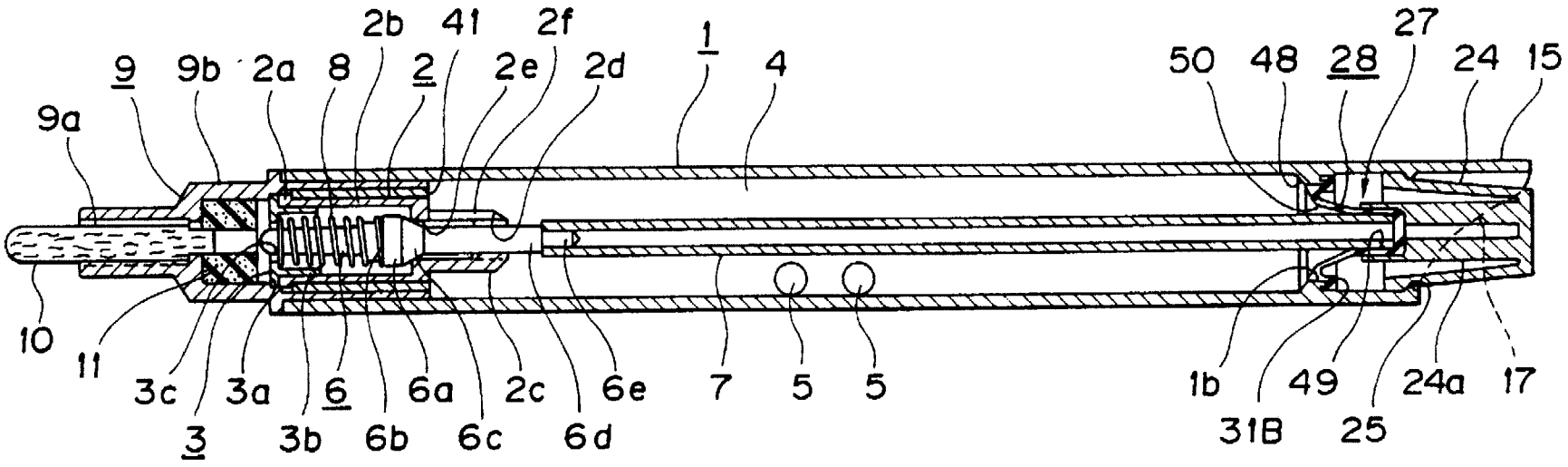
FIG. 25 is a vertical sectional view showing a writing implement in accordance with the eighth embodiment.

Next, still another variational example of the tail clicking structure of the invention will be explained. That is, FIG. 25 shows a writing implement having a tail clicking structure as the eighth embodiment. The overall configuration of main parts of the writing implement is the same with that of the first embodiment shown in FIG. 1 or the seventh embodiment shown in FIG. 17. Therefore, the repeated components are allotted with the same reference numerals and the description will be omitted. The main difference of the eighth embodiment from the seventh embodiment resides in the modifications of the structure of the projected portion **1*b* and therearound as well as the shape of the resilient body 28**.

Specifically, the projected portion **1*b* has a roughly L-shaped cross-section and the front face of the projected portion 1*b* is defined by an annular slanting surface 48 which is formed from the inner peripheral surface of the barrel cylinder 1 and is inclined backward. The inner peripheral surface which lies ahead of the projected portion 1*b* of the barrel cylinder 1** is so shaped as to allow the mold core for forming the inner peripheral surface to be separable in the forward direction.

The resilient body 28 is molded with an elastic material after the projected portion **1*b* has been molded, so that the outer peripheral part 31B will hermetically grip the projected portion 1*b*. Further, the resilient body 28 has a depressed portion 49 which is formed at a substantially center thereof and will mate with the rear end of the small-diameter pipe 7. The depressed portion 49 is a bag-like hollow which has a substantially circular cross-section and is opened up to the front side. A slanting surface 50 is formed in the front part of the depressed portion 49 in order to guide the rear end of the small-diameter pipe 7 toward the center when the small-diameter pipe 7 is inserted into the barrel cylinder 1 from the front side at the time of assembly. The slanting surface 50 is composed of the front-side slanting surface 50*a* which is even with the annular slanting surface 48 of the projected portion 1***b* and a rear-side slanting surface 50*b* which is inclined closer to the axial direction than the front-side slanting surface 50*a*. The resilient body 28 thus configurated is formed inside the barrel cylinder 1 after the molding of the barrel cylinder 1 by means of the bi-color molding machine using a resilient material which is dissimilar from that of the barrel cylinder. The resilient material 28 is made up of a rubber material such as elastomer etc.

The push cap 24 is a molding article which, as shown in FIG. 25, is tapered or somewhat reduced in its diameter toward the rear end and has an inner pipe-like rib 24*a*. The push cap 24 is held inside the barrel cylinder 1 by a projection 25 which is formed on the inner peripheral surface of the cover portion 15 whilst the rib 24*a* is being fitted on the outer side of the depressed portion 49 of the resilient body 28.

The assembly of the writing implement is carried out as follows: Initially, with the valve rod 6, valve spring 8, valve seat 2, spring receiver 3, sponge piece 11, and spacer 41 assembled inside the front barrel 9, the small-pipe 7 is connected with the valve rod 6. In this condition, the small-diameter pipe 7 is inserted into the barrel cylinder 1 from the front side of the barrel cylinder 1 so as to be fitted into the depressed portion 49 of the resilient body 28 and thereafter the front barrel 9 is fixed to the barrel cylinder 1 with an appropriate fixing means.

Figure 26:
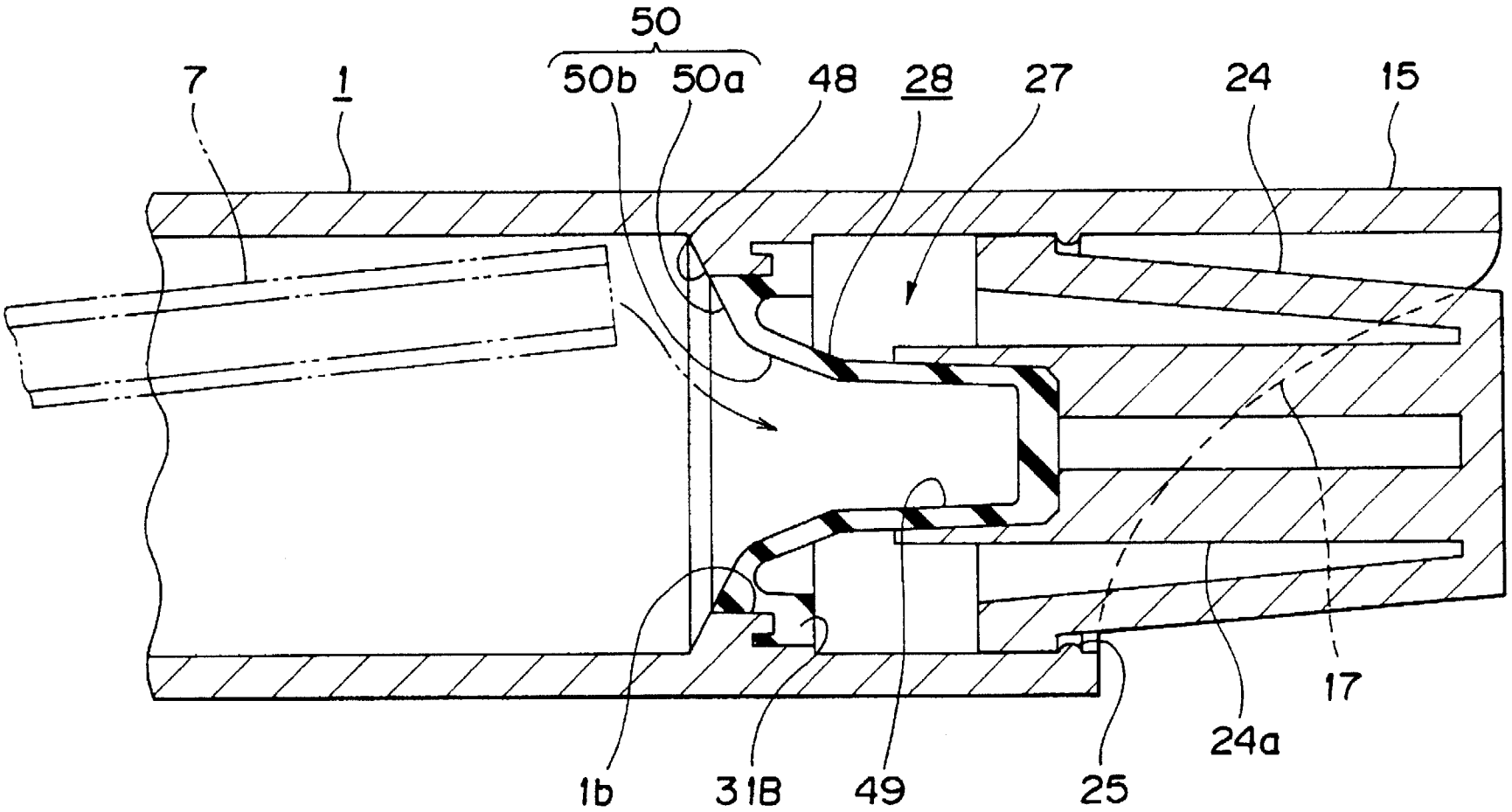
FIG. 26 is a vertical sectional view showing a barrel cylinder and a resilient body in accordance with the eighth embodiment.

When the small-diameter pipe 7 is inserted into the barrel cylinder from the front side at the time of assembling, if the small-diameter pipe 7 inserted inside the barrel cylinder 1 is inclined against the central axis of the barrel cylinder 1 as shown in FIG. 26, the small-diameter pipe 7 is guided to the central position of the depressed portion 49 along the slanting surface 48 of the projected portion 1*b* and the front-side slanting surface 50*a* or the rear-side slanting surface 50*b* of the resilient body 28. Accordingly, at the time of assembling, it is possible to readily position the rear end of the small-diameter pipe 7 to the center of the clicking portion 27. Besides, since the rear end of the small-diameter pipe 7 is fitted in the depressed portion 49, it is possible to reliably hold the small-diameter pipe 7 in the clicking portion 27 during even clicking operations.

Figure 27:
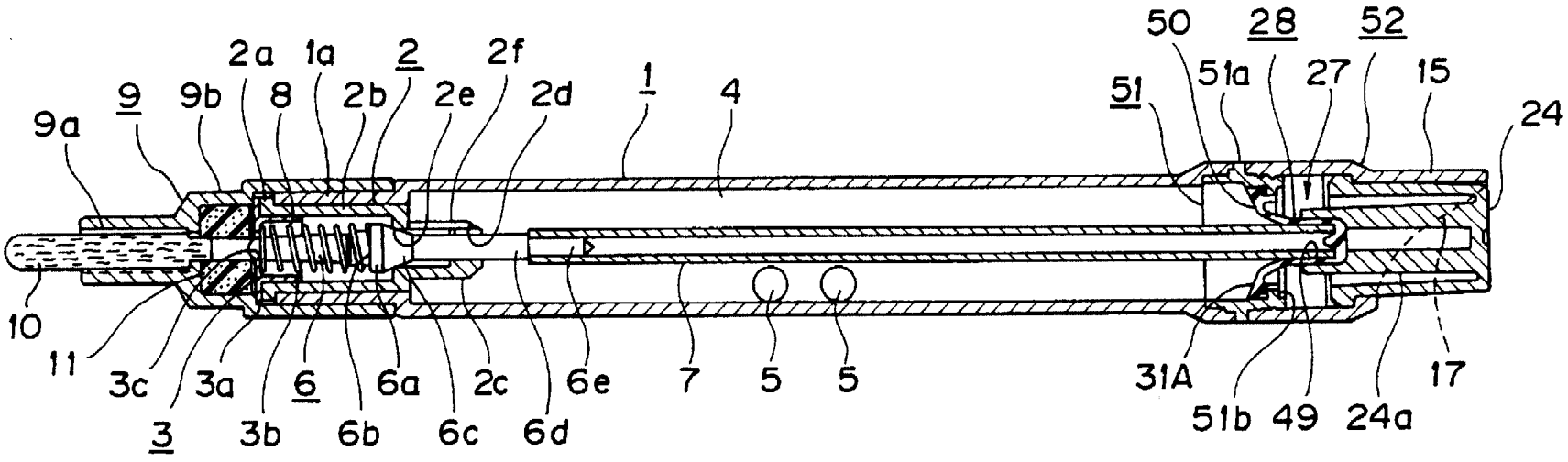
FIG. 27 is a vertical sectional view showing a writing implement in accordance with the ninth embodiment.

Next, a writing implement of the ninth embodiment will be described. The ninth embodiment includes front-side and rear-side tail barrels 51 and 52 which are separated from the barrel cylinder 1, as shown in FIG. 27.

Figure 28:
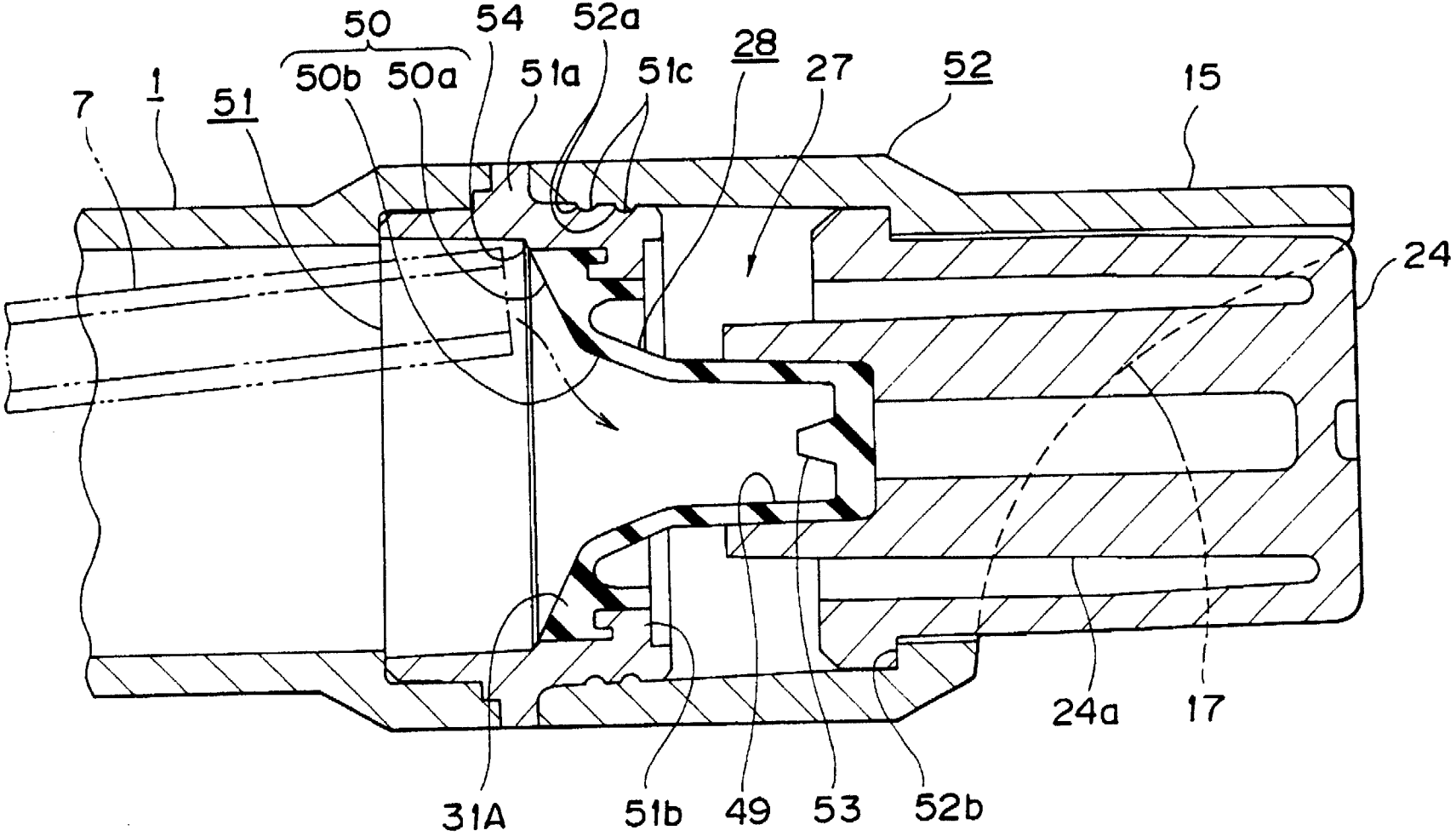
FIG. 28 is a vertical sectional view showing a barrel cylinder, a front-side tail barrel, a rear-side tail barrel and a resilient body in accordance with the ninth embodiment.

The front-side tail barrel 51 has a flange portion 51*a* on its outer peripheral, as shown in FIG. 28, and is inserted (squeezed or screwed etc.) into the tail part of the barrel cylinder 1 until the flange portion 51*a* abuts the tail end of the barrel cylinder 1. In the rear end on the inner peripheral surface of the front-side tail barrel 51, a projected portion 51*b* which is projected inwardly from the entire circumference on the inner peripheral surface and bent in the axially forward direction in the upper part of the projection is integrally molded of a synthetic resin material. The resilient body 28 is molded with an elastic material after the projected portion 51*b* has been formed so that the outer peripheral part 31A hermetically grips the projected portion 51*b*. Formed in the approximately center of the resilient body 28 is a depressed portion 49 which is opened up to the front side so as to mate with the rear end of the small-diameter pipe 7. In front of the depressed portion 49, a slanting surface 50 is formed which guides the rear end of the small-diameter pipe 7 to the central position of the depressed portion 49 when the small-diameter pipe 7 is inserted into the barrel cylinder 1 from the front side at the time of assembling. A pipe-holding projection 53 having a substantially truncated cone shape to be fitted to the rear end opening of the small-diameter pipe 7 is integrally formed on the bottom of the depressed portion 49.

The slanting surface 50 is composed of a front-side slanting surface 50*a* and a rear-side slating surface 50*b* as in the eighth embodiment. Provided on the inner peripheral surface of the front-side tail barrel 51 is a slanting surface 54 which is formed substantially even with the front-side slanting surface 50*a*.

The front-side tail barrel 51 as well as the resilient body 28 thus configurated is formed by the bi-coloer molding machine. The resilient body 28 is formed on the inner peripheral surface of the front-side tail barrel 51 after the front-side tail barrel 51 has been formed. Here, in the ninth embodiment, since there is no projected portion on the inner peripheral surface of the barrel cylinder 1, it is possible to separate the core for forming the inner peripheral surface of the barrel cylinder 1 toward the axial tail-end side. Accordingly, as shown in FIG. 27, it is possible to form the mouth portion 1*a* of the barrel cylinder 1 with a smaller diameter and fix the front barrel 9 to the outer peripheral surface of the mouth portion 1*a*. In this case, the space 41 which is used in the eighth embodiment will not be needed.

The rear-side tail barrel 52 is integrally formed with a cover portion 15 and a cutout 17, and is fitted into the rear part of the front-side tail barrel 51 so as to hold the flange portion 51*a* of the front-side tail barrel 51 in cooperation with the tail end of the barrel cylinder 1. The fixture between the front-side tail barrel 51 and the rear-side tail barrel 52 is not specified particularly, but can be formed so that, for example, a groove 51*c* formed on the outer periphery in the rear part of the front-side tail barrel 51 is mated with a fitting projection 52*a* formed on the inner periphery in the front part of the rear-side tail barrel 52, as shown in FIG. 28. Further, the push cap 24 is held inside the rear-side tail barrel 52 by means of a stepped portion 52*b* formed on the inner peripheral surface of the rear-side tail barrel 52.

In accordance with the ninth embodiment thus configured, it is possible to obtain the same effects as in the eighth embodiment. At the same time, the pipe-holding projection 53 of the depressed portion 49 establishes more reliable holding of the small-diameter pipe 7 in the center of the clicking portion 27. Further, as described above, since the front-side tail barrel 51 formed separately from the barrel cylinder 1 is provided for the clicking portion 27, it is possible to omit the spacer 41 used in the eighth embodiment, thus making it possible to reduce the number of parts for the pen tip.

Figure 29:
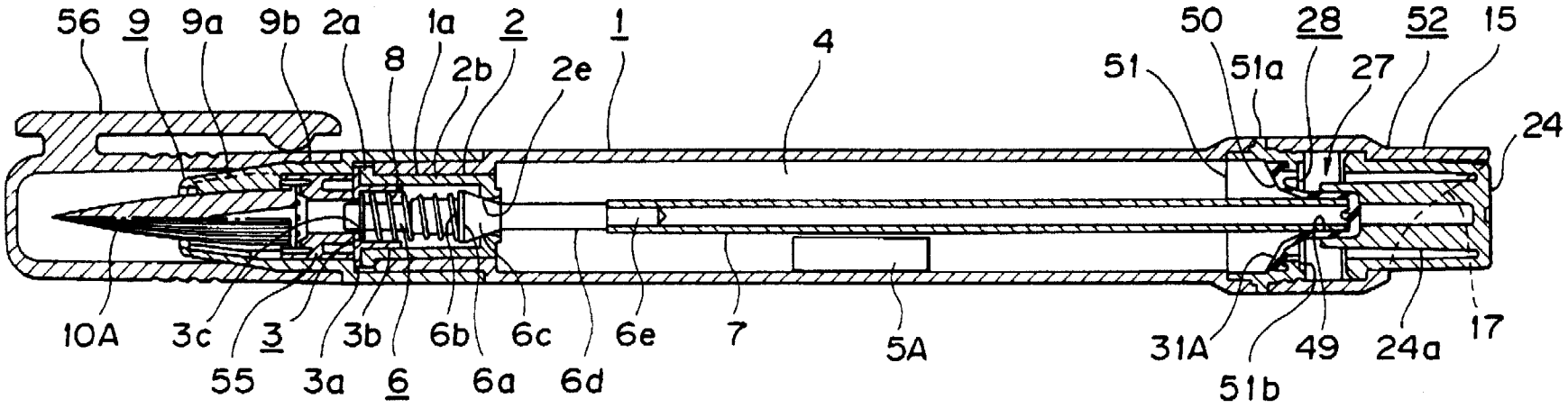
FIG. 29 is a vertical sectional view showing a writing implement in accordance with a variational example of the ninth embodiment.

It is noted that the eighth and ninth embodiments are mere preferred modes of the invention and the technical scope of the invention should not be limited by these embodiments. For example, the clicking structure at the tail end can widely be applied to other liquid applicators such as a writing implement having a brush of bristles 10A held inside the front barrel 9 by means of a holder 55, as shown in FIG. 29. Here, in the variational example shown in FIG. 29, the valve seat 2 is formed of the feature with the small-diameter tubular portion 2*c* omitted. In FIG. 29, a reference numeral 5A designates a cylindrical agitating bar, and a reference number 56 designates a cap.

Further, the projected portion in the invention will not be limited to one which has a roughly L-shaped cross-section. Specifically, a projected portion which is projected inwardly from the inner peripheral surface of the barrel cylinder and bent in the both the axially forward and rearward directions in the upper part to form a roughly T-shaped cross-section.

In accordance with the invention as shown in the eighth and ninth embodiments, in the clicking structure at the tail of the liquid applicators such as writing implements, cosmetic applicators etc., it is possible to readily set the rear end of the connecting part to the center of the clicking portion when the applicator is assembled. Further, it is also possible to surely hold the rear end of the connecting part in the clicking portion.

What is claimed is:

1. A liquid applicator comprising:

a barrel cylinder storing an applying liquid therein;

a clicking portion which is disposed at the tail end of said barrel cylinder and is pressed forward during the clicking operation to reduce the content volume of the liquid applicator;

a connecting part which is connected at the end thereof with said clicking portion and is extended forward inside said barrel cylinder;

a valve rod which is connected to the front end of said connecting part and has a large-diameter portion projected outward in the radial directions;

a valve seat of a substantially cylindrical shape, which is fitted in the front end opening of said barrel cylinder for slidably supporting said valve rod at a position behind the large-diameter portion, and against which the large-diameter portion is abutted during the non-clicking state and from which the large-diameter portion is separated during the clicking action;

an urging means abutted against the rear end of the large-diameter portion for urging said valve rod backward;

a supporting member which is fitted in the front end portion of said valve seat for supporting the front end of said urging means and has a guide hole for guiding the front end portion of said valve rod; and an applying piece which is disposed in front of the guide hole and to which the applying liquid is supplied from said barrel cylinder through the gap between the large-diameter portion and said valve seat and the gap between the guide hole and said valve rod when clicking is performed.

2. A liquid applicator according to claim 1 wherein the front end of said connecting part abuts the rear end of said valve seat when the connecting part is moved forward by a predetermined stroke length.

3. A liquid applicator according to claim 1 wherein said valve rod has a stepped surface which abuts the surface of the inner peripheral wall of the guide hole when said valve rod is moved forward by a predetermined stroke length.

4. A liquid applicator according to claim 3 wherein the supplying passage of the applying liquid to said applying piece is blocked by the combination of the stepped surface of said valve rod and the surface of the inner peripheral wall of the guide hole when said valve rod is moved forward by a predetermined stroke length.

5. A liquid applicator according to claim 1 wherein the large-diameter portion of said valve rod abuts the rear end of the supporting member when said valve rod is moved forward by a predetermined stroke length.

6. A liquid applicator according to claim 5 wherein the supplying passage of the applying liquid to said applying piece is blocked by the combination of the large-diameter portion of said valve rod and the rear end of said supporting member when said valve rod is moved forward by a predetermined stroke length.

7. A liquid applicator according to claim 1 wherein said clicking portion is formed in a tail plug which is fitted in the rear end part of said barrel cylinder, and comprises: a thin wall which is attached on the inner peripheral wall of the tail plug and is connected to the rear end of said connecting part; a push cap which is connected to the rear face of the thin wall and is capable of sliding back and forth along the inner peripheral wall of the tail plug behind the thin wall; and a projection against which the front end of the push cap abuts when the push cap is moved forward by a predetermined stroke length.

8. A clicking mechanism located at the tail end of a liquid applicator such as a writing implement, a cosmetic applicator and the like, which has a barrel cylinder storing an applying liquid therein and a clicking portion disposed at a tail end thereof and clicked in the axial direction to open a valve provided inside so that the applying liquid flows out from the applying piece, said clicking mechanism comprising:

a resilient body which seals the tail end and can restorably be deformed during clicking operations; and a projected portion which is made up of a synthetic resin material and integrally formed on the entire circumference of the inner peripheral surface of the tail end in such a manner that the projected portion is projected inward from the inner surface and has a bent portion in the upper part thereof which extends to at least one side along the axial direction, wherein after the projected portion has been formed, said resilient body is molded of an elastic material in such a manner that a circular outer part of said resilient body hermetically grips the projected portion.

9. A clicking mechanism located at the tail end according to claim 8 wherein said clicking mechanism comprises:

a resilient body which seals the tail end of the barrel cylinder and can restorably be deformed during clicking operations; and a projected portion which is made up of a synthetic resin material and integrally formed on the entire circumference of the inner peripheral surface of the tail end of the barrel cylinder in such a manner that said projected portion is projected inward from the inner surface and has a bent portion in the upper part thereof which extends to at least one side along the axial direction, and after said projected portion has been formed, said resilient body is molded of an elastic material in such a manner that a circular outer part of said resilient body hermetically grips said projected portion, and the inner peripheral surface of the barrel cylinder which lies ahead of said projected portion has a feature which allows the core for forming the inner peripheral surface to be separated forward.

10. A clicking mechanism located at the tail end according to claim 8 wherein the valve is opened via a connecting part so as to allow the applying liquid to flow through the applying piece, said resilient body has a depressed portion at the approximately central portion thereof which is opened up to the front side and into which the rear end of the connecting part is fitted, and a slanting surface for guiding the rear end of the connecting part to the center of the depressed portion when the connecting part is inserted into the barrel cylinder from the front side at the time of assembling is formed in front of the depressed portion.

* * * * *